US012807885B2

(12) United States Patent
Zellhuber et al.

(10) Patent No.: US 12,807,885 B2
(45) Date of Patent: Nov. 24, 2026

(54) METHOD AND PLANT FOR STEAM CRACKING

(71) Applicant: LINDE GMBH, Pullach (DE)

(72) Inventors: Mathieu Zellhuber, Martinsried (DE); David Bruder, Munich (DE); Michael Horenz, Munich (DE); Stefan Glomb, Munich (DE); Christopher Eberstein, Kirchham (DE)

(73) Assignee: Linde GmbH, Pullach (DE)

( * ) Notice: Subject to any disclaimer, the term of this patent is extended or adjusted under 35 U.S.C. 154(b) by 261 days.

(21) Appl. No.: 18/549,586

(22) PCT Filed: Mar. 8, 2022

(86) PCT No.: PCT/EP2022/055873
§ 371 (c)(1),
(2) Date: Sep. 7, 2023

(87) PCT Pub. No.: WO2022/189421
PCT Pub. Date: Sep. 15, 2022

(65) Prior Publication Data

US 2025/0026986 A1 Jan. 23, 2025

(30) Foreign Application Priority Data

Mar. 10, 2021 (EP) ..... 21161729

(51) Int. Cl.
*C10G 9/36* (2006.01)

(52) U.S. Cl.
CPC ..... *C10G 9/36* (2013.01); *C10G 2300/4012* (2013.01); *C10G 2300/4081* (2013.01)

(58) Field of Classification Search
None
See application file for complete search history.

(56) References Cited

U.S. PATENT DOCUMENTS 3,426,733 A 2/1969 Wiesenthal
4,107,226 A 8/1978 Ennis, Jr. et al.
(Continued)

FOREIGN PATENT DOCUMENTS

CN 1358222 A 7/2002
CN 106164222 A 11/2016
(Continued)

OTHER PUBLICATIONS

Sinatra et al. "Polimeri Europa Olefin Plant Maximizes Benefits from Advanced Solutions" 2003 AIChE Spring National Meeting. pp. 1-29 (Year: 2003).*
(Continued)

*Primary Examiner* — Renee Robinson
*Assistant Examiner* — Alyssa L Cepluch
(74) *Attorney, Agent, or Firm* — Avek IP, LLC

(57) ABSTRACT

A method for reacting one or more hydrocarbons by steam cracking including conducting one or more input streams containing the one or more hydrocarbons, obtaining one or more product streams, through one or more radiation zones of one or more cracker furnaces, in which the one or more radiation zones are heated by firing heating gas with combustion air, in which at least a portion of the combustion air is subjected to combustion air preheating in which steam is produced from feed water, and in which the feed water is subjected to feed water preheating in one or more convection zones of the one or more cracker furnaces. The combustion air preheating is carried out at least in part and/or at least temporarily using heat withdrawn from at least part of the feed water upstream of the feed water preheating.

14 Claims, 23 Drawing Sheets

(56) References Cited

U.S. PATENT DOCUMENTS

| | | | | |
|---|---|---|---|---|
| 4,321,130 | A | 3/1982 | Bacsik | |
| 4,617,109 | A | 10/1986 | Wells et al. | |
| 4,912,282 | A | 3/1990 | Klaus | |
| 9,989,305 | B2 | 6/2018 | Mak | |
| 2003/0175642 | A1* | 9/2003 | Stephens | F23L 7/005 431/9 |
| 2006/0116543 | A1 | 6/2006 | Bellet et al. | |
| 2010/0031625 | A1 | 2/2010 | Narayan et al. | |
| 2014/0109465 | A1 | 4/2014 | Coppola et al. | |
| 2014/0212823 | A1 | 7/2014 | Novak et al. | |
| 2016/0097002 | A1 | 4/2016 | Sundaram | |
| 2017/0022429 | A1 | 1/2017 | Van Willigenburg | |
| 2020/0172814 | A1 | 6/2020 | Oud | |
| 2020/0290939 | A1 | 9/2020 | Willigenburg | |
| 2021/0171836 | A1 | 6/2021 | Purola | |
| 2022/0395805 | A1 | 12/2022 | Mortensen | |
| 2023/0407186 | A1 | 12/2023 | Sundaram et al. | |
| 2024/0158700 | A1 | 5/2024 | Zellhuber et al. | |
| 2024/0158701 | A1 | 5/2024 | Horenz et al. | |
| 2024/0158702 | A1 | 5/2024 | Zellhuber et al. | |
| 2024/0239728 | A1 | 7/2024 | Keller et al. | |
| 2025/0026986 | A1 | 1/2025 | Zellhuber et al. | |

FOREIGN PATENT DOCUMENTS

| | | | |
|---|---|---|---|
| CN | 109844068 | A | 6/2019 |
| CN | 111944556 | A | 11/2020 |
| CN | 112368235 | A | 2/2021 |
| DE | 710185 | C | 9/1941 |
| DE | 1615278 | A1 | 7/1970 |
| DE | 2362628 | A1 | 6/1975 |
| DE | 3334334 | A1 | 4/1985 |
| DE | 4128180 | A1 | 2/1993 |
| DE | 102004020223 | A1 | 11/2005 |
| EP | 0229939 | A1 | 7/1987 |
| EP | 0229939 | B1 | 11/1988 |
| EP | 3075704 | A1 | 10/2016 |
| EP | 3249027 | A1 | 11/2017 |
| EP | 3249028 | A1 | 11/2017 |
| EP | 3415587 | A1 | 12/2018 |
| EP | 3730592 | A1 | 10/2020 |
| EP | 3748138 | A1 | 12/2020 |
| JP | S62148591 | A | 7/1987 |
| JP | 2010038537 | A | 2/2010 |
| JP | 2020523466 | A | 8/2020 |
| JP | 2020152916 | A | 9/2020 |
| WO | 2005113713 | A2 | 12/2005 |
| WO | 2013178446 | A1 | 12/2013 |
| WO | 2014090914 | A1 | 6/2014 |
| WO | 2015197181 | A1 | 12/2015 |
| WO | 2018020399 | A1 | 2/2018 |
| WO | 2018065919 | A1 | 4/2018 |
| WO | 2018229267 | A1 | 12/2018 |
| WO | 2020035575 | A1 | 2/2020 |
| WO | 2020150244 | A1 | 7/2020 |
| WO | 2020150248 | A1 | 7/2020 |
| WO | 2020150249 | A1 | 7/2020 |
| WO | 2021052642 | A1 | 3/2021 |
| WO | 2022189423 | A1 | 9/2022 |

OTHER PUBLICATIONS

International Search Report and Written Opinion issued in related App. No. PCT/EP2022/055873, mailed Apr. 20, 2022.

Office Action and Search Report issued Oct. 21, 2025 in corresponding Chinese Application No. 202280034298.0, 6 pages.

Office Action issued Mar. 27, 2026 in Chinese patent application No. 202280020029.9.

Office Action issued Jan. 27, 2026 in JP Application No. 2023-555248.

* cited by examiner

METHOD AND PLANT FOR STEAM CRACKING

CROSS-REFERENCE TO RELATED APPLICATIONS

This application is the national phase of, and claims priority to, International Application No. PCT/EP2022/055873, filed Mar. 8, 2022, which claims priority to European Patent Application No. EP21161729.5, filed Mar. 10, 2021.

FIELD OF THE INVENTION

The invention relates to a method and to a system for steam cracking.

BACKGROUND

The invention relates to steam cracking (steam splitting, thermal splitting, steam cracking, etc.) which is used for the production of olefins and other basic chemicals, and which is described, for example, in the article "Ethylene" in Ullmann's Encyclopedia of Industrial Chemistry, online publication of 15 Apr. 2009, DOI: 10.1002/14356007.a10_045.pub2. With regard to the terms used below, reference is also made to corresponding specialist literature.

For the initiation and maintenance of the endothermic reactions, in steam cracking the required thermal energy is typically provided by the combustion of heating gas in a combustion chamber, which forms what is known as the radiation zone of a cracking furnace or cracker furnace, and through which what are known as coils (cracking tubes) are conducted, through which a hydrocarbon-steam mixture to be reacted is passed to obtain a product mixture, referred to as the raw or cracking gas. In the most frequent applications, the combustion air required for the combustion is conducted into the radiation zone without preheating (referred to as natural drawing) and combusted there together with the heating gas. A simplified illustration is shown in the accompanying FIG. 1, which is explained first below, with the corresponding reference signs.

A cracker furnace 10 shown in FIG. 1 or a corresponding furnace unit (also referred to here as a cracking furnace or furnace for short) comprises the radiation zone 11 and a convection zone 12. A system for steam cracking can contain multiple corresponding cracker furnaces 10. In the following, multiple cracker furnaces 10 are available as system components or units denoted as central, peripheral units are provided separately for each cracker furnace 10.

A hydrocarbon input H is heated by means of central input preheating 20, shown by way of example, and central process steam generating 30, and process steam P is provided, which is further heated in the convection zone 12 in a manner known per se (see in particular also FIG. 4), combined to form a feed stream F, and then fed to the radiation zone 11. As mentioned, the illustration according to FIG. 1 is greatly simplified and merely by way of example. Thus, for example, in what is referred to as fitted control, a corresponding feed stream can already be divided into multiple partial flows in the region of the convection zone 12, said partial flows then being preheated separately from one another and finally being able to be guided in the radiation zone 11 by groups of, for example, six or eight cracking tubes in each case. Here and in the following, central units can be replaced at any time by peripheral units, and vice versa.

The cracking gas C is taken from the radiation zone 11, which gas can be cooled by means of one or more cracking gas coolers 13, which can be formed in particular as known quench coolers or can comprise such quench coolers, and which can at the same time also function as steam generators, and then can be fed to central cracking gas separation and cracking gas preparation 90. Further details of corresponding quench coolers, which can be designed in particular as conventional quench coolers or what are known as linear quench exchangers (LQE), are explained below. The invention is not limited by a specific embodiment.

Feed water W is provided by means of a central feed water system 40, which water, in the example shown, is likewise heated in the convection zone 12 and subsequently heated further and finally evaporated by means of the one or more cracking gas coolers 13, obtaining high-pressure or super-high-pressure steam S (hereinafter also referred to as saturated steam for short). In the example shown, the saturated steam S is superheated in the convection zone 12, obtaining superheated high-pressure steam or superheated super-high-pressure steam T (hereinafter also referred to, simplified, as superheated steam), and fed into a central steam system 50.

By means of a central heating gas system 60, which is connected downstream of possible central heating gas preheating 65, in which process or auxiliary agents, such as superheated steam at high, medium or low pressure, washing water and/or quenching oil, but also electric current, are used as heating media or heat sources, feed heating gas Y is heated to form preheated heating gas X, and fed into the radiation zone 11 or burners therein (not illustrated separately).

In the embodiment illustrated here, combustion air L passes through an air intake 79 into the radiation zone 11 or the burners there. Flue gas Z is discharged from the radiation zone 11, which gas passes through the convection zone 12 and then is discharged into flue gas treatment or to a central or peripheral chimney 80, with or without a blower, and thereby to the atmosphere.

The central heating gas preheating 65 illustrated in FIG. 1 is optional. A peripheral heating gas preheating (i.e., separately for the individual cracker furnaces 10 or oven units) is also possible. The same applies to the input preheating and the process steam generation, which can also be carried out peripherally, as an alternative to the central design.

It is known from the prior art that the preheating of the combustion air can be applied as an efficiency-increasing measure in order to save heating gas and in this way to reduce the energy consumption and carbon dioxide emissions. Corresponding embodiments are shown in FIGS. 2 and 3, FIG. 2 showing central and FIG. 3 peripheral combustion air compression 70 and combustion air preheating 75.

In general, the term "increase in efficiency" can be understood here in particular as an increase in what is known as the specific efficiency, which in turn is understood to mean the portion of the introduced heating gas energy which is recovered in the products formed, here the cracking gas. This differs from what is known as the thermal efficiency, that is to say the portion of the underfiring power which is recovered in the products and other media (cracking gas or steam), or, in other words, that portion which is not lost as heat loss into the surroundings (via chimney, hot surfaces, leaks). The specific efficiency is increased by the air preheating because less underfiring is required with the same amount of cracking gas. The thermal efficiency, in contrast, does not necessarily increase by the application of air preheating, since this is possibly also limited by a minimum flue gas delivery temperature (see below).

In the following, centrally and peripherally arranged units are provided with the same reference signs. The type of arrangement follows from the illustrated positioning inside or outside the respective cracker furnace 10 or the furnace unit, a peripheral arrangement being present in the case of positioning inside, and a central arrangement in the case of positioning outside. For example, a central combustion air compression 70 can also take place in the case of peripheral combustion air preheating 75. The combustion air is hereinafter also referred to as air, for short, and the preheating thereof also referred to for short as air preheating.

In the air preheating, for example a use of superheated steam or, depending on the use, also steam which is not superheated, at high, medium or low pressure, or washing water and/or quenching oil as heating media, or electric current as a heat source, can take place. The use of directly transferred heat of the exhaust gas stream Z as a heat source is also possible. The use of superheated high-pressure or super-high-pressure steam T shown in the figures is optional and is carried out depending on the selected preheating temperature.

Again to sum up, the preheated combustion air can thus be provided centrally or peripherally. Depending on the availability and the desired preheating temperature, it is possible to use (superheated) super-high-pressure steam, (superheated) high-pressure steam, (superheated) medium-pressure steam, (superheated) low-pressure steam, saturated steam, washing water or quenching oil, as heating media, for example from a central cracking gas separation and cracking gas preparation, or flue gas after exit from the convection zone, typically in the case of a peripheral arrangement of the air preheating.

Low-pressure steam is understood here to mean generally steam at a pressure level of 1 to 10 bar absolute pressure (abs.), in particular 4 to 8 bar (abs.), medium-pressure steam is understood to mean steam at a pressure level of 10 to 30 bar (abs.), in particular of 15 to 25 bar (abs.), high-pressure steam is understood to mean steam at a pressure level of 30 to 60 bar (abs.), in particular of 35 to 50 bar (abs.), and super-high-pressure steam is understood to mean steam at a pressure level of 60 to 175 bar (abs.), in particular of 80 to 125 bar (abs.). If high-pressure steam is subsequently referred to in the following, for short, super-high-pressure steam should also be understood.

The term super-high pressure level refers to the pressure level specified for super-high-pressure steam, irrespective of whether this is specified for the steam itself or for example for feed water used to form the steam. The same applies to the terms high pressure level, medium pressure level and low pressure level.

To provide the pressure level required for the flow through the air preheater used in the air preheating, or to compensate for a corresponding pressure loss, the air sucked in from the atmosphere can be compressed by means of a driven fan in the air compression, either centrally or peripherally. Alternatively, it is also possible to use a blower arranged downstream of the air preheating, which causes a corresponding suction.

The air preheating is described in connection with steam cracking, for example in U.S. Pat. No. 3,426,733 A, EP 0 229 939 B1 and EP 3 415 587 A1, and in connection with the air preheating in boilers, for example in DE 10 2004 020 223 A1 and WO 2013/178446 A1.

It is known from U.S. Pat. No. 4,321,130 A that combustion air can be preheated before introduction into a cracking furnace in a system for pyrolytic conversion and separation of hydrocarbons with the aid of bottom, top and/or quenching water streams, which are discharged from a primary fractionation unit, which is connected externally to the pyrolysis reactor, in order to optimize the thermal efficiency of the overall process.

US 2020/172814 A1 discloses a cracking furnace system for converting a hydrocarbon input material into cracking gas, the cracking furnace system comprising a convection portion, a radiating portion, and a cooling portion, the convection portion including a plurality of convection banks configured to absorb and preheat the hydrocarbon feed material, the radiating portion including a firing space comprising at least one radiant coil configured to heat the input material to a temperature that allows a pyrolysis reaction, the cooling portion including at least one transfer line heat exchanger.

The air preheating generally improves the heat transfer in the radiation zone and reduces the fuel requirement of the furnace. Thus, with the same furnace load (here in particular understood to mean the same amount of hydrocarbons and the same cracking intensity, which results in the same product stream), overall less firing power has to be expended and at the same time a larger relative portion of the exhaust gas energy is transferred to the process gas. On the one hand, this results in the exhaust gas mass flow being reduced, as a result of which the combustion emissions and the residual heat output from the chimney to the atmosphere are reduced. On the other hand, it follows from this that the amount of heat remaining in the flue gas at the exit of the radiation zone is significantly reduced compared to a non-preheated furnace.

However, in the case of increasing preheating temperatures, this leads to difficulties in the design and operation of the downstream convection zone. In said zone, the hydrocarbon input to be split and the associated process steam are preheated to temperatures of 550 to 700° C. In addition, boiler feed water supplied to the furnace at a high or super-high pressure level is normally preheated at 100 to 110° C. in the convection zone, evaporated in the cracking gas cooler, and finally superheated in the convection zone.

Due to the reduced availability of exhaust gas heat in the convection zone, the difficulty arises in the case of high air preheating temperatures that, with the same furnace load, the required preheating capacity for the hydrocarbon input and the process steam, as well as the required superheating capacity for the saturated steam stream produced in the cracking gas cooler, are virtually unchanged. The lack of exhaust gas heat is thus noticeable in the feed water preheating, which must be partially restricted. In addition, in the case of the upper convection bundles in the convection zone, i.e., the heat exchange units arranged here, for the transfer of heat of the flue gas to the media to be heated, the inlet temperatures of the flue gas significantly decrease compared to the non-preheated furnace. As a result of the decreasing temperature gradients, the surface area requirement of the convection bundles is thus significantly greater, which requires a higher construction effort.

In EP 3 415 587 A1 this problem is intended to be solved, for example, by a heat pump system or by feeding non-preheated feed water into the steam drum. However, the solutions proposed therein lead to a high additional effort in terms of apparatus, due to the required heat pump and/or to significantly changed embodiments of the cracking gas cooling and steam generation, for which in particular proof of permanent operability has not yet been provided.

SUMMARY

The invention is therefore intended to provide solutions by means of which an economic, efficient and practically implementable operation of a system for steam cracking is possible.

According to one embodiment, a method for reacting one or more hydrocarbons by steam cracking includes conducting one or more input streams containing the one or more hydrocarbons, obtaining one or more product streams, through one or more radiation zones of one or more cracker furnaces. The one or more radiation zones are heated by firing heating gas with combustion air. At least a portion of the combustion air is subjected to combustion air preheating. Steam is produced from feed water, and the feed water is subjected to feed water preheating in one or more convection zones of the one or more cracker furnaces. The combustion air preheating is carried out at least in part and/or at least sometimes using heat withdrawn from at least a portion of the feed water upstream of the feed water preheating.

According to another embodiment, a system for reacting one or more hydrocarbons by steam cracking includes one or more cracker furnaces. Each furnace has one or more radiation zones and is configured to guide one or more input streams, containing the one or more hydrocarbons, through the one or more radiation zones of the one or more cracker furnaces, obtaining one or more product streams. The system further includes one or more burners for heating the one or more radiation zones by firing heating gas with combustion air. Combustion air preheating is designed to heat at least a portion of the combustion air in the combustion air preheating. One or more steam generators is/are designed to generate steam from feed water. The system is designed to subject the feed water in one or more convection zones of the one or more cracker furnaces to a feed water preheating. The combustion air preheating comprises heat transfer means which are designed to transmit heat at least occasionally to the combustion air which is withdrawn from at least a portion of the feed water upstream of the feed water preheating.

WRITTEN DESCRIPTION

Figure 1:
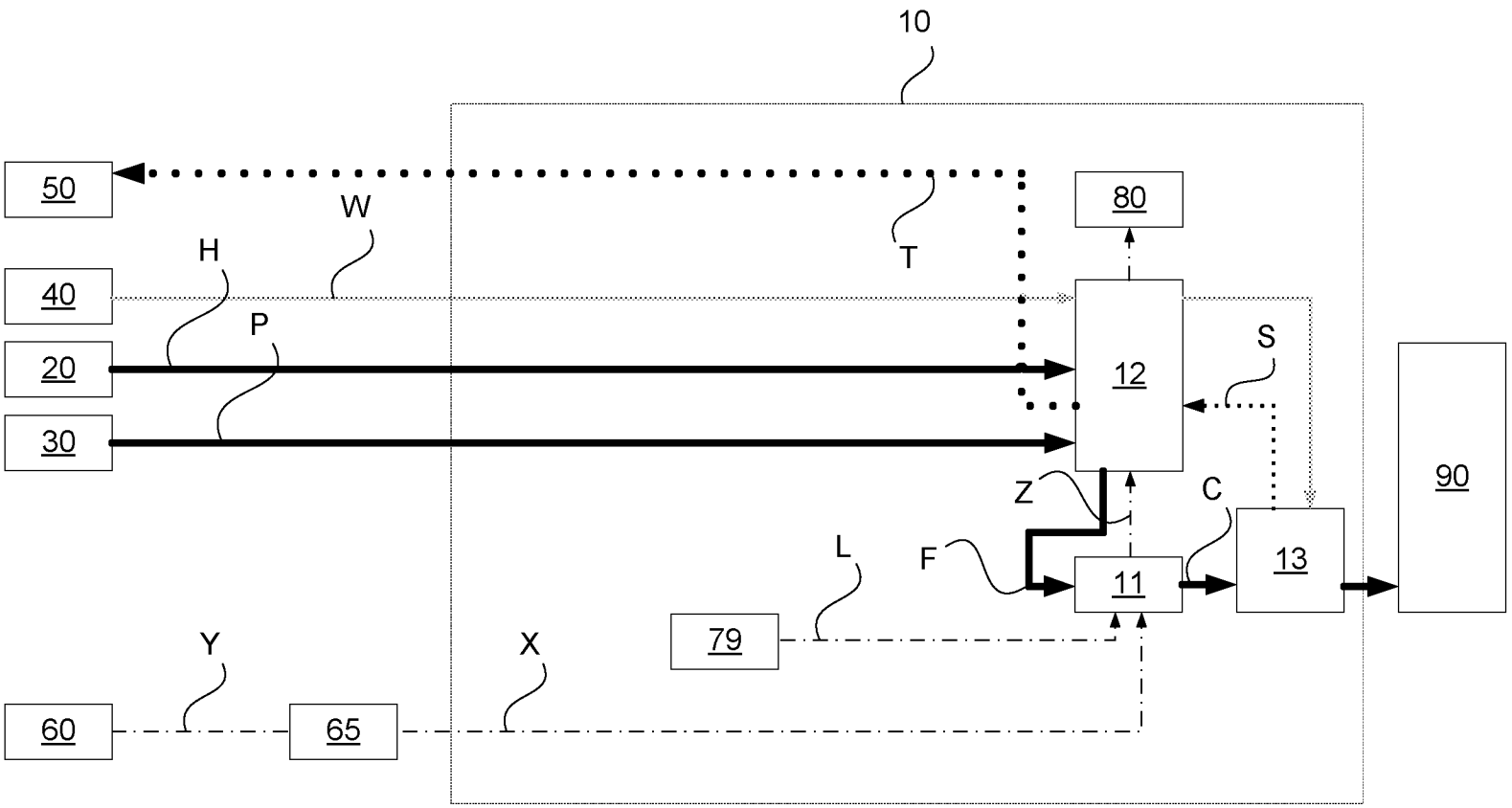
FIGS. 1 to 4 show arrangements not according to the invention.

The invention makes it possible to realize an extremely compact design of the convection zone, viewed here as the sum of the heights of the individual convection bundles in the flue gas channel, a simple construction of the chimney lines downstream of the convection zone, and a maximum flue gas heat utilization, i.e., low flue gas exit temperature at the chimney. Furthermore, a minimum fuel requirement with maximum possible production of superheated high-pressure or super-high-pressure steam can be achieved.

In this case, the core concept of the invention is the use of feed water, i.e., water which is subsequently used to produce (super-)high-pressure steam, for the preheating of combustion air.

The measures proposed according to the invention, which lead to intermediate cooling of feed water, contradict familiar practice of aiming for a maximum feed water preheating in steam production from firing plants. In this case, in the context of the invention, a maximum steam generation is deliberately dispensed with in order to achieve maximum energy recovery from the flue gas with minimal structural complexity. In this case, the decrease in steam production is particularly advantageous in the light of future embodiments of steam cracking systems, since this enables an increased use of preferably what is known as green electricity for driving machines. In this way, the carbon dioxide emissions of the system can be reduced even further overall. The firing use is minimized at maximum energy yield from the remaining firing of fossil fuels.

While in the case of a pure steam boiler application only the fuel utilization degree for steam generation is to be optimized, the situation in a steam cracking furnace is a great deal more difficult. The generation of steam here, after the chemical conversion of the feed material, is only the secondary task or a requirement for utilizing the amounts of heat obtained. Accordingly, the use of the measures according to the invention in the steam cracking furnace influences not only the degree of fuel utilization overall, but in particular also the distribution between chemical process use and steam generation. Therefore, measures which are provided in pure steam boilers cannot be readily transferred to steam cracking systems.

In further embodiments according to the invention and not according to the invention, alternatively or in addition to the measures proposed according to the invention, a use of (super-)high-pressure steam specific to the furnace as the heating medium in air preheating, a combined use of feed water and (super-)high-pressure steam as the heating media in the air and/or heating gas preheating, a use of (super-)high-pressure steam as the heating medium for the process steam superheating, and a use of (super-)high-pressure saturated steam as the heating medium for input preheating, or a combined use of (super-)high-pressure steam as the heating medium for the process steam superheating and the input preheating, can take place.

The invention proceeds from a method for reacting one or more hydrocarbons by steam cracking, in which one or more input streams containing the one or more hydrocarbons are conducted, obtaining one or more product streams, i.e., cracking gas streams or crude gas streams, through one or more radiation zones of one or more cracker furnaces, in which the one or more radiation zones are heated by firing heating gas with combustion air, in which at least a portion of the combustion air is subjected to combustion air preheating in which steam is produced from feed water, and in which the feed water is subjected to feed water preheating in one or more convection zones of the one or more cracker furnaces. As mentioned, the input streams can also be guided in one or more convection zones in parallel, for example in accordance with the division into multiple groups of cracking tubes in the radiation zone.

According to the invention, as already mentioned, the combustion air preheating is carried out using heat, which is removed from at least a portion of the feed water upstream of the feed water preheating.

The invention thus comprises a supply of cooled feed water to the convection zone of the furnaces or furnaces, whereby the greatest possible cooling and thus energetic use of the flue gas can be achieved. There are various variants for the cooling of the feed water, in which in particular the heating gas quality can be taken into account in order to avoid corrosion in the exhaust gas tract. In addition to the use of the feed water supplied to the furnaces as a heating medium in a central or peripheral air heating, as explained below the feed water can additionally, or, according to embodiments not according to the invention, alternatively, be used as a heating medium in a central or peripheral heating gas preheating. Cooling can, alternatively and according to embodiments not according to the invention, take place outside the furnace process.

The feed water preheating can be carried out in particular in such a way that only one, in particular adjustable, first portion of the feed water in one or more combustion air preheaters is used for heat exchange with at least a portion of the combustion air to be heated, and, optionally, in one or more heating gas preheaters for a heat exchange with at least a portion of the heating gas to be heated, and an, in particular adjustable, second portion of the feed water is guided as a bypass flow around the combustion air preheater and optionally the heating gas preheater. The first and second parts can subsequently be combined again and then fed to the feed water preheating in the convection zone.

In particular in the case of an intended adjustability of the first and/or second part of the feed water, it is possible in this way to control the temperature of the feed water at the entry into the convection zone. The latter can in particular be used during operation to control the exit temperature of the flue gas in the chimney. The latter depends greatly on the temperature of the feed water in such a method regime.

With such a temperature control, it is thus possible, in particular, for example with a variable heating gas composition which could lead to a risk of corrosion in the case of partial condensation of the flue gas, to shift the flue gas temperature during operation, in particular temporarily, upwards. In this case, less air preheating is achieved via feed water, and the corresponding power can be compensated by subsequent air preheating stages or via an increased fuel supply in the furnace. In the optimal operating case with a preferred heating gas composition, a maximum preheating capacity by means of feed water is sought, which thus also leads to a maximum utilization of flue gas heat.

In other words, the temperature of the flue gas can be set by setting a portion of the feed water which is used in the air preheating and optionally also the heating gas preheating, which can take place in particular on the basis of a temperature of a flue gas to be achieved or detected in the convection zone downstream of the feed water preheating.

In general, the invention is used in a method in which the steam produced from the feed water comprises superheated or non-superheated high-pressure or super-high-pressure steam which is generated from the feed water downstream of the feed water preheating. In this case, at least a portion of the feed water can be subjected to feed water evaporation after the feed water preheating using heat which is withdrawn from at least part of the one or more product streams, in particular in one or more cracking gas or quench coolers, obtaining high-pressure or super-high-pressure steam. At least a portion of the high-pressure or super-high-pressure steam can then be subjected to steam superheating in one or more convection zones, in order to obtain the (superheated) high-pressure or super-high-pressure steam. For further details, reference is made to the explanations relating to FIGS. 1 to 4.

In general, in this case, in the context of the invention, the combustion air preheating can be carried out using heat which is removed from a portion of the (superheated) high-pressure or super-high-pressure steam. In embodiments according to the invention, this is carried out in addition to the use of the heat of the feed water, and, in embodiments not according to the invention, as an alternative to this.

As already mentioned several times, the heating gas can be subjected to heating gas preheating which can likewise be carried out using heat which is withdrawn from at least a portion of the feed water upstream of the feed water preheating. This is carried out in embodiments according to the invention in addition to the combustion air preheating, and can take place alternatively thereto in embodiments not according to the invention.

In the context of the invention, the feed water preheating is performed in one or more flue gas channels in the one or more convection zones, the feed water preheating being performed in particular at a lower temperature level than is used for the steam superheating for maintaining the superheated high-pressure or super-high-pressure steam, process steam heating to provide process steam that is used to form the one or more input streams, and a majority of the input heating of the one or more input streams is performed. In particular, the feed water preheating takes place close to the end or at the very end of the flue gas channel, from which the then correspondingly cooled flue gas flows out, that is to say at most a further heat recovery from the flue gas takes place at a point downstream (in the flow direction of the flue gas). In this way, the exit temperature of the flue gas from the convection zone can be controlled particularly advantageously.

In the context of the invention, the feed water can be provided in particular at a temperature level of 80 to 140° C., in particular by means of a central or peripheral feed water system, and the feed water can be cooled to a temperature level of 40 to 100° C., to 95° C., to 90° C. or to 85° C., during the combustion air preheating.

In the context of the invention, the feed water can be supplied to the combustion air preheating at a pressure level of 30 to 60 bar (abs.), in particular of 35 to 50 bar (abs.), or of 60 to 175 bar (abs.), in particular of 80 to 125 bar (abs.), and can be subjected at this pressure level to the feed water preheating without additional application of pressure. Alternatively, the feed water can be supplied to the combustion air preheating at a pressure level of 20 to 60 bar (abs.), in particular between 25 to 50 bar (abs.) or between 30 and 40 bar (abs.), and subsequently, after an additional pressure application, be subjected to the feed water preheating at a pressure level of 30 to 60 bar (abs.), in particular of 35 to 50 bar (abs.), or of 60 to 175 bar (abs.), in particular of 80 to 125 bar (abs.). In the latter case, the feed water can advantageously be brought to a corresponding pressure by means of one or more pumps after the combustion air preheating.

The air can thus be preheated directly using feed water at a (super)-high-pressure level, so that the intermediately cooled feed water can subsequently be fed directly to the convection zone. Alternatively, the air preheating can also take place using feed water at a reduced pressure level, as explained. The latter leads to a significantly lower design pressure of the associated air preheater and thus to a lower effort for this apparatus.

In the context of the invention, as also mentioned above, multiple cracker furnaces can be used, which are supplied with the feed water by means of a central feed water system, wherein it is possible for the combustion air preheating to be carried out separately for each of the plurality of cracker furnaces (peripheral combustion air preheating) or together for the plurality of cracker furnaces (central combustion air preheating).

Embodiments according to the invention and not according to the invention are explained further below and in particular with reference to FIGS. 5 to 22.

In all embodiments of the invention, the combustion air preheating can be carried out in particular in multiple stages, wherein it is possible for example for feed water to be used as the heating medium in a first stage, medium-pressure steam to be used as the heating medium in a second stage, and saturated or superheated (super-) high-pressure steam to be used as the heating medium in a third stage.

Further possible heating types or heating media (inter alia electric current) can also be used. Furthermore, more or less than the aforementioned preheating stages can also be provided. It is also possible in this case to fully or partially reuse outflowing heating medium (in particular condensate formed) in previous stages (i.e., at a lower temperature level), preferably directly at the same pressure level in a heat exchanger in which the previously formed condensate is further cooled down, or after partial expansion to a reduced pressure level and addition of superheated steam at this reduced pressure level. Optionally a return of condensate to steam generation either by corresponding height arrangement (above the steam drum, i.e., natural circulation) or by increasing the pressure (e.g., using a pump) is also advantageous.

The correspondingly cooled feed water is then fed to the convection zone, but at a noticeably reduced temperature.

The invention also relates to a system for reacting one or more hydrocarbons by steam cracking.

With regard to the system provided according to the invention and its features, reference is expressly made to the above explanations of the method according to the invention, since these likewise concern a corresponding system. The same applies in particular to an embodiment of a corresponding system which is advantageously configured for carrying out a corresponding method in any embodiment.

Applied individually or preferably in combination, the inventive and non-inventive measures described in the context of the present application enable the structural complexity and/or the energy efficiency of steam cracking furnaces with air preheating to be measurably improved, as explained again below with reference to specific examples.

A first result of the effects of the individual measures is presented in Table 1. A furnace subjected to the same hydrocarbon load without air preheating but with central heating gas preheating (reference A, 100% basis for relative comparison of the evaluation variables) is used as a first comparison system. A furnace subjected to the same hydrocarbon load with air preheating and with central heating gas preheating, but not according to the features of the invention, is set out as a second comparison system. (Reference B). All of the cases with air preheating listed in Table 1 are based on a resulting combustion air temperature of 248° C. at the entry of the radiation zone. The variants indicated with 1F, 2A, 3B, 4B, 5B and 6B are explained with reference to the figures and represent inventive and non-inventive variants.

TABLE 1

Comparison of efficacy for air preheating temperature of 248° C.

| Variant of the invention/reference | | Ref. A | Ref. B | Ex. 1F** | Ex. 2A* | Ex. 3B** | Ex. 4B** | Ex. 5B** | Ex. 6B** |
|---|---|---|---|---|---|---|---|---|---|
| Temperature of the combustion air | ° C. | 15 | 248 | 248 | 248 | 248 | 248 | 248 | 248 |
| Relative summed bundle height | % | 100% | 136% | 141% | 86% | 108% | 92% | 106% | 91% |
| Relative fuel consumption | % | 100% | 78% | 78% | 78% | 78% | 78% | 78% | 78% |
| Temperature of the flue gas at the outlet | ° C. | 119 | 138 | 89 | 189 | 91 | 91 | 91 | 91 |
| Rel. Super-high-pressure steam export from furnace | % | 100% | 64% | 73% | 59% | 61% | 59% | 61% | 58% |

*embodiment without use of feed water in air preheating
embodiment with use of feed water in air preheating All variants denoted in Table 1 with the addition  are designed according to the invention, since feed water is provided as heating medium for the air preheating.

The essential advantage of the air preheating is shown in the comparison of reference A with reference B, in the form of a fuel consumption reduced by 22%. The same comparison shows that, in the case of air-preheated furnaces, further measures are required in order to compensate for the increased structural complexity (in the form of summed bundle height) and the reduction in the furnace efficiency (in the sense of the above-described thermal efficiency) associated with the rising flue gas exit temperature. The embodiments according to the invention described below aim to compensate these two disadvantages simultaneously and as well as possible.

The comparison of variant 1F with reference B shows that the use of feed water for the air preheating, with subsequent infeed into the convection zone at a reduced temperature level (according to the invention, hereinafter referred to as measure 1) leads to a significantly reduced flue gas exit temperature and thus to an improved furnace energy efficiency. The additional construction effort to be accepted in return is very low, with an increase of 5 percentage points, with at the same time a decrease in the exit temperature of barely 50 K. A similar picture emerges when comparing variants 2A and 3B. These two comparisons clearly emphasize the effectiveness of measure 1, which makes it possible, with little additional construction effort, to bring about significant improvements in the furnace efficiency.

Another great advantage of measure 1 is the simple design of the flue gas guide after exit from the convection zone. This is very similar to that of a furnace without air preheating, and thus significantly simpler than when using a direct heat exchanger between exhaust gas flow and combustion air, in which large-volume tube arrangements and heat exchange surfaces have to be installed in the flue gas path of each individual furnace. Measure 1 produces a similar process effect, namely the transfer of exhaust gas heat to the combustion air, but indirectly by means of a heat transfer medium (feed water) already present in the furnace region, which requires significantly smaller tube cross sections due to its liquid state of aggregation.

Another advantage is the described possible temperature control via the described bypass guide, so that, in contrast to a system with direct heat exchange between combustion air and exhaust gas flow, a simple adjustment/change of the exhaust gas temperature during operation is possible. Fluctuations in the heating gas quality can thus be handled significantly better; see preceding description.

The effect of the air preheating using (super-)high-pressure saturated steam (considered alone, non-inventive measure 2) can be illustrated by means of the comparison of variants 1F and 2A. As a result of the removal of (super-)high-pressure steam upstream of the superheater bundles for (super-)high-pressure steam, proportionally more exhaust gas heat is available for the bundles located further downstream in the flue gas path. The temperature differences in the bundles increase, as a result of which the surface area requirement and the resulting height of the convection zone decrease very sharply. The sole use of measure 2 thus results in a considerable minimization of the construction effort, but with decreasing energy efficiency of the furnace, since the flue gas exit temperature increases by 100 K.

It follows from this that measures 1 and 2 have quasi contrary effects. By comparison of reference B with example 3B, however, it is very clear that a combination of measures 1 and 2 (referred to as inventive measure 3) leads to a simultaneous improvement of the furnace in terms of construction complexity and energy efficiency.

The comparison of variant 3B with variant 4B shows the effect of additional process steam superheating using (super-)high-pressure saturated steam (considered alone, non-inventive measure 4). Similarly to measure 2, this removal of saturated steam and its use for the superheating of process steam leads to a reduction of the construction effort, which, in the given example, by combining with measures 1 (inventive) and 2 (considered alone, non-inventive), results in a consistent furnace energy efficiency.

The comparison of variant 3B with variant 5B shows the effect of an additional input preheating using (super-)high-pressure saturated steam (considered alone, non-inventive measure 5). Similarly to measures 2 and 4 (in each case, considered alone, non-inventive), this removal of saturated steam and its use for input preheating leads to a reduction in the construction effort, which, in the given example 5B, results in a constant furnace energy efficiency by simultaneous application of measures 1 (inventive) and 2 (considered alone, non-inventive).

The comparison of variant 4B or variant 5B with variant 6B shows the effect of the joint application of process steam superheating and input preheating using (super-)high-pressure saturated steam (considered alone, non-inventive measure 6). The maximum removal of saturated steam and its use for the superheating of process steam and input preheating leads to a maximum reduction in the construction effort, which, in the given example, leads to a constant furnace energy efficiency as in variants 3B, 4B and 5B, by simultaneous application of measures 1 (inventive) and 2 (non-inventive).

The variants listed in Table 1 use different embodiments of the air preheater sequences, with three stages, with the use of washing water, medium-pressure steam and/or superheated (super-)high-pressure steam, in addition to the explained use of feed water and/or (super-)high-pressure steam.

As an additional illustration of the effectiveness of the claimed measures, Table 2 shows results for embodiments of various variants in the case of yet further increased air preheating (300° C.) and correspondingly further reduced fuel consumption. The described effects of the measures apply unchanged in this case. The comparison of variants 4A* with 4B* shows the positive influence of measure 2 on the construction effort. The comparison of Example 4B* with 4B shows the added value in terms of furnace efficiency with the addition of measure 1**.

TABLE 2

Comparison of efficacy for air preheating temperature of 300° C.

| Variant of the invention/reference | | Ref. A | Ref. B | Ex 4A* | Ex 4B* | Ex. 4B** | Ex. 6B** | Ex. 6C** |
|---|---|---|---|---|---|---|---|---|
| Temperature of the combustion air | ° C. | 15 | 248 | 300 | 300 | 300 | 300 | 300 |
| Relative summed bundle height | % | 100% | 136% | 158% | 109% | 116% | 111% | 117% |
| Relative fuel consumption | % | 100% | 78% | 73% | 73% | 73% | 73% | 73% |
| Temperature of the flue gas at the outlet | ° C. | 119 | 138 | 119 | 118 | 88 | 89 | 89 |
| Rel. Super-high-pressure steam export from furnace | % | 100% | 64% | 55% | 56% | 56% | 55% | 57% |

*embodiment without use of feed water in air preheating

**embodiment with use of feed water in air preheating

All variants marked with the addition ** in Table 2 are designed according to the invention, since feed water is provided as the heating medium for the air preheating.

It is generally shown that at higher preheating temperatures the combination of a plurality of measures offers comparatively a greater added value. For example, the construction effort is reduced in the comparison of variant 4B with 6B, i.e., after the addition of measure 6 to measures 1 and 2, in this case by 5 percentage points. As a further maximum combined embodiment, variant 6C shows the possibility of achieving an increased steam export by means of increased construction effort in comparison with variant 6B, with virtually the same furnace efficiency. In this case, this is achieved by means of a series connection of process steam superheating and input preheating on the heat transfer medium side, i.e., the condensate formed in the process steam superheating is used downstream as a heat transfer medium for the input preheating.

The examples listed in Table 2 use different embodiments of the air preheater sequences, with 2, 3 or 4 stages, with use of low-pressure steam and/or superheated (super-)high-pressure steam, in addition to the explained use of feed water and/or (super-)high-pressure steam.

The invention can also be used in particular in a system as described for example in EP 3 415 587 A1, and in which a direct cooling of the cracking gas is carried out against the input stream, and thus only a portion of the heat output during the cooling of the cracking gas is used for the generation of (super-)high-pressure steam. Specifically, the application of the measures described in the instant application also provides the same or at least approximately the same advantages in such a system.

The invention can also be applied in a system with separation of carbon dioxide from the flue gas. Particularly in the case of application of inventive measure 1, particularly low exit temperatures of the flue gas at the end of the convection zone are achieved, which is advantageous for subsequent removal of carbon dioxide, for example by means of an amine scrubbing (typical operating temperatures of amine scrubbing are 20 to 60° C.).

In one embodiment of the invention, an enrichment of the combustion air with oxygen can also take place. In this case, no particular purity requirement/concentration is necessary, for example the by-product of water electrolysis can be used, or any other technical source, such as an air separation plant, can be used. The effect of oxygen enrichment is approximately comparable to the air preheating, since the adiabatic combustion temperature is increased in each case and thus an increased radiation zone efficiency and reduced flue gas quantity follow. The effect is not (entirely) equivalent to the air preheating, since the relatively higher oxygen content (at a lower content of nitrogen etc.) achieves the equivalent effect with somewhat different flue gas composition. Specifically, proportionally more carbon dioxide and water are formed from the combustion—the former is, for example, advantageous in the recovery of the carbon dioxide by means of amine scrubbing and would be even more so in the case of any flue gas recirculation. The advantage is, moreover, that radiation zone efficiency or flue gas reduction, and thus underfiring saving beyond the described values for air preheating using (super-)high-pressure steam can be achieved.

As already explained, the measures can be used for steam cracking furnaces with all possible hydrocarbon inputs. Examples include hydrocarbons having two, three and/or four carbon atoms (gaseous), naphtha (liquid), gas oil (liquid), and products of recycling methods such as plastics recycling (gaseous and liquid).

In all cases, the entire or only a portion of the combustion air can be preheated. Partial air preheating can, for example, be selected for the case that both floor burners and side burners are used, and only some of the burners are supplied with preheated air, preferably the floor burners. In the context of this application, the indicated numerical values for air preheating temperatures always refer to the resulting preheating temperature of the entirety of the combustion air. Process streams from other systems (e.g., gas turbine exhaust gas) can also be used for the preheating of the furnace air.

In variants 4 to 6, the heating of separate water or hydrocarbon streams against (super-)high-pressure steam is described in each case. To the same extent, it can be provided that a mixed substance stream of hydrocarbon and water is heated in this way. This embodiment is relevant in particular for use in the case of gaseous inputs, since in this case there is no aggregate change in the input in the convection zone.

The described use of saturated steam relates to the hitherto typical and technically used level of up to about 175 bar (abs.). Alternatively, however, a partial provision of saturated steam at a higher pressure and temperature level (e.g., 175 bar abs. and 355° C.) for a further preheating and/or superheating use in the furnace region is also conceivable.

The invention is preferably used in combination with the electric drive of individual or multiple compressors in the associated separating part of the system. As a result, the reduction of the (super-)high-pressure steam export from the furnaces, caused by the air preheating according to the invention, is preferably compensated. Such an increased electrification of the system additionally enables an increased utilization of regenerative energies by means of importing from the power grid. A maintenance of steam boilers as backup systems for the system start is also required to a lesser extent.

The described measures can be applied both in the case of a complete new construction of steam cracking furnaces and in the case of modernization of existing furnaces. In the latter case, in particular the advantages with respect to summed bundle height are of high relevance if, for example, it is necessary to accommodate modified bundle structures in an already existing steel construction.

The invention is further explained below with reference to the figures which illustrate embodiments of the invention in comparison to the prior art.

In the further description above and in the following, systems and, on the basis thereof, corresponding method steps not according to the invention and those formed according to embodiments of the invention have been or are described. Merely for the sake of simplicity and to avoid unnecessary repetition, in this case the same reference signs and explanations have been or are used for method steps and system components (for example, a cooling step and a heat exchanger used for this purpose). In the figures, identical reference signs are used for identical or comparable components, and these are also not explained repeatedly, simply for the sake of clarity.

Figure 2:
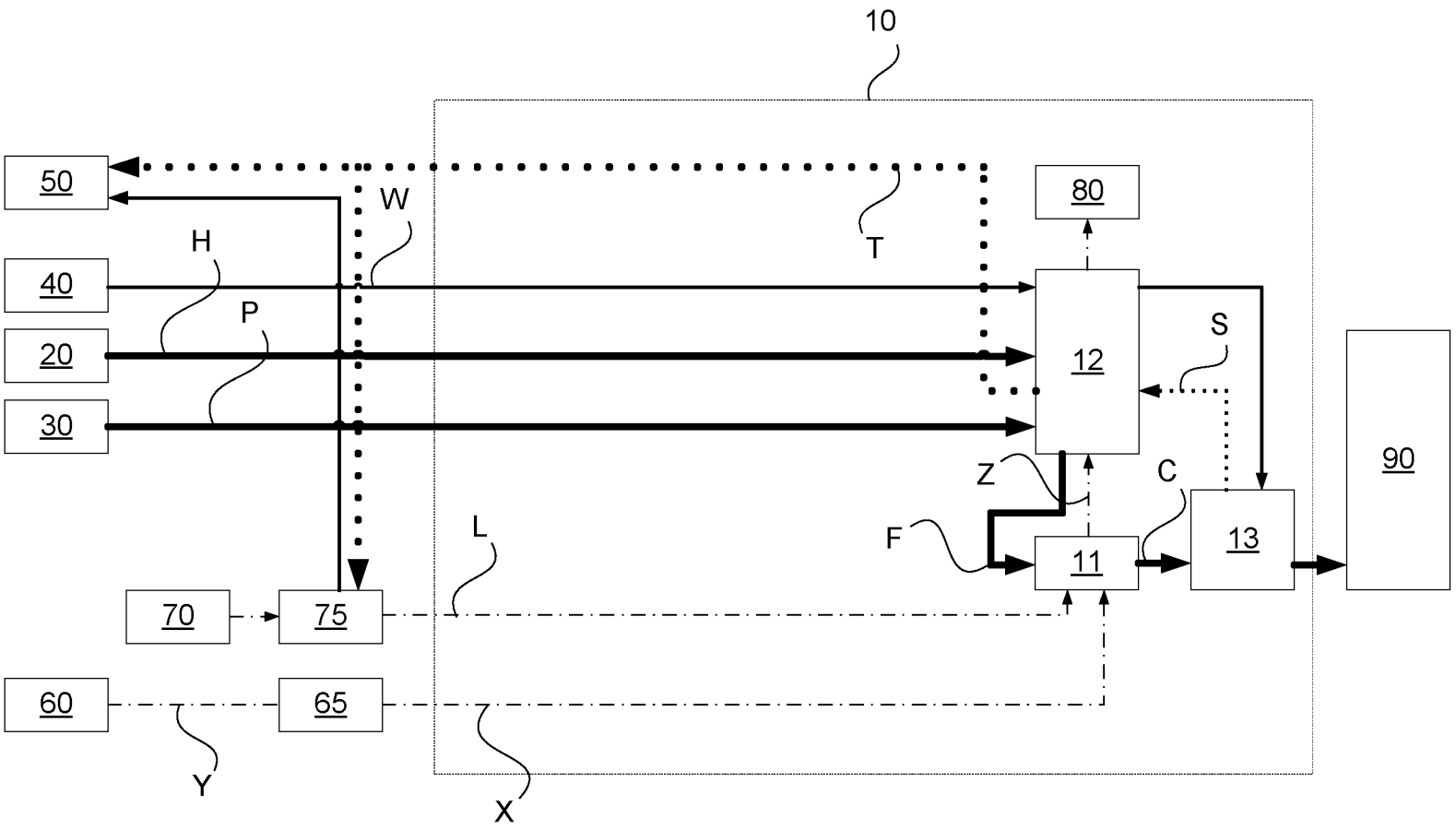
Figure 3:
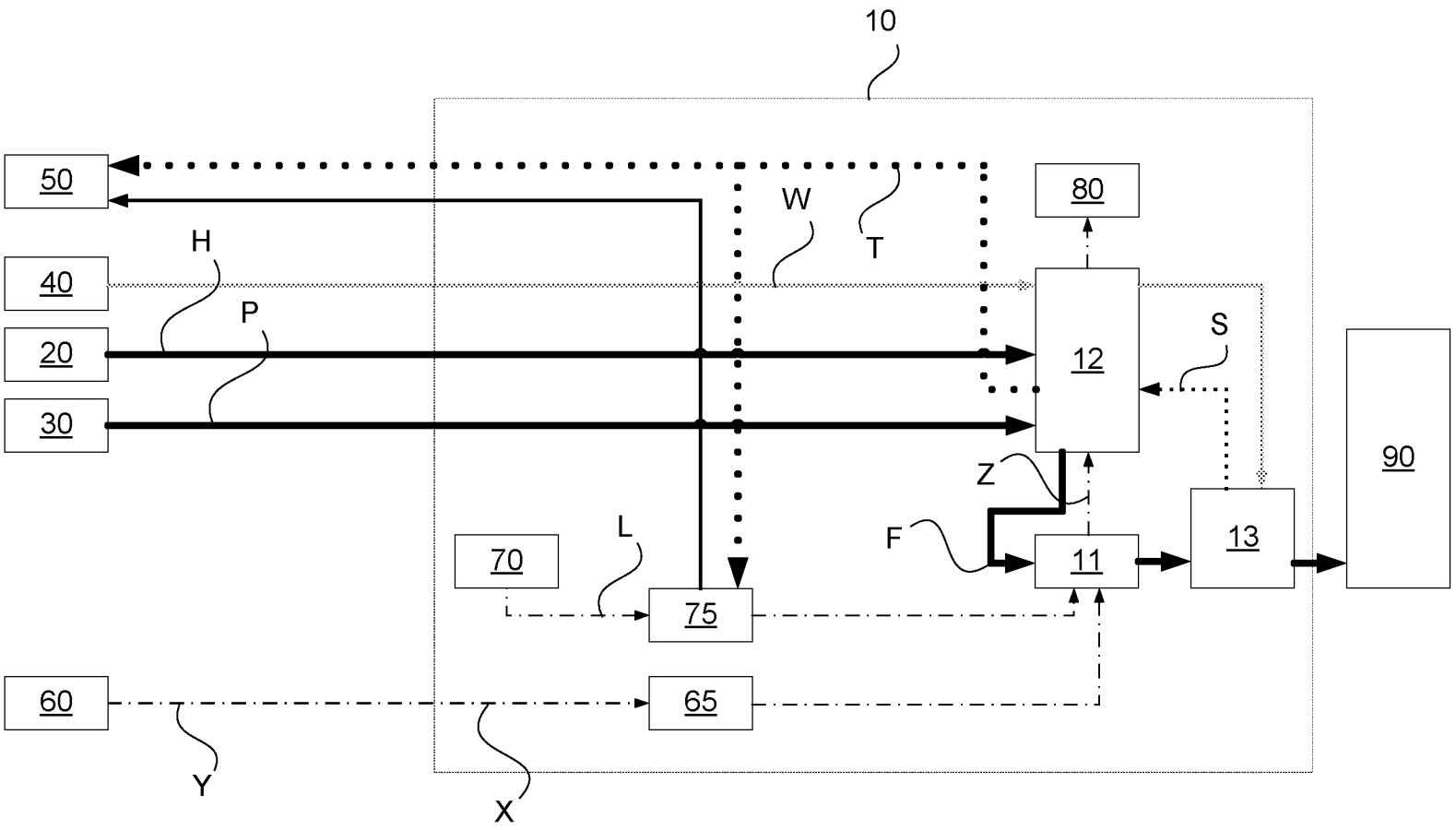

The advantages of the invention and corresponding embodiments are described below in particular in comparison to the embodiments according to the prior art shown in FIGS. 1 and 2 described above (without air preheating and with central heating gas preheating according to FIG. 1, and with air preheating to, for example, approximately 248° C. according to FIG. 2, but central heating gas preheating as illustrated in FIG. 1). In this case, these considerations are based on a cracker furnace with naphtha as the input. However, the different aspects of the invention apply equally to furnaces with gas or heavier liquid inputs.

Figure 4:
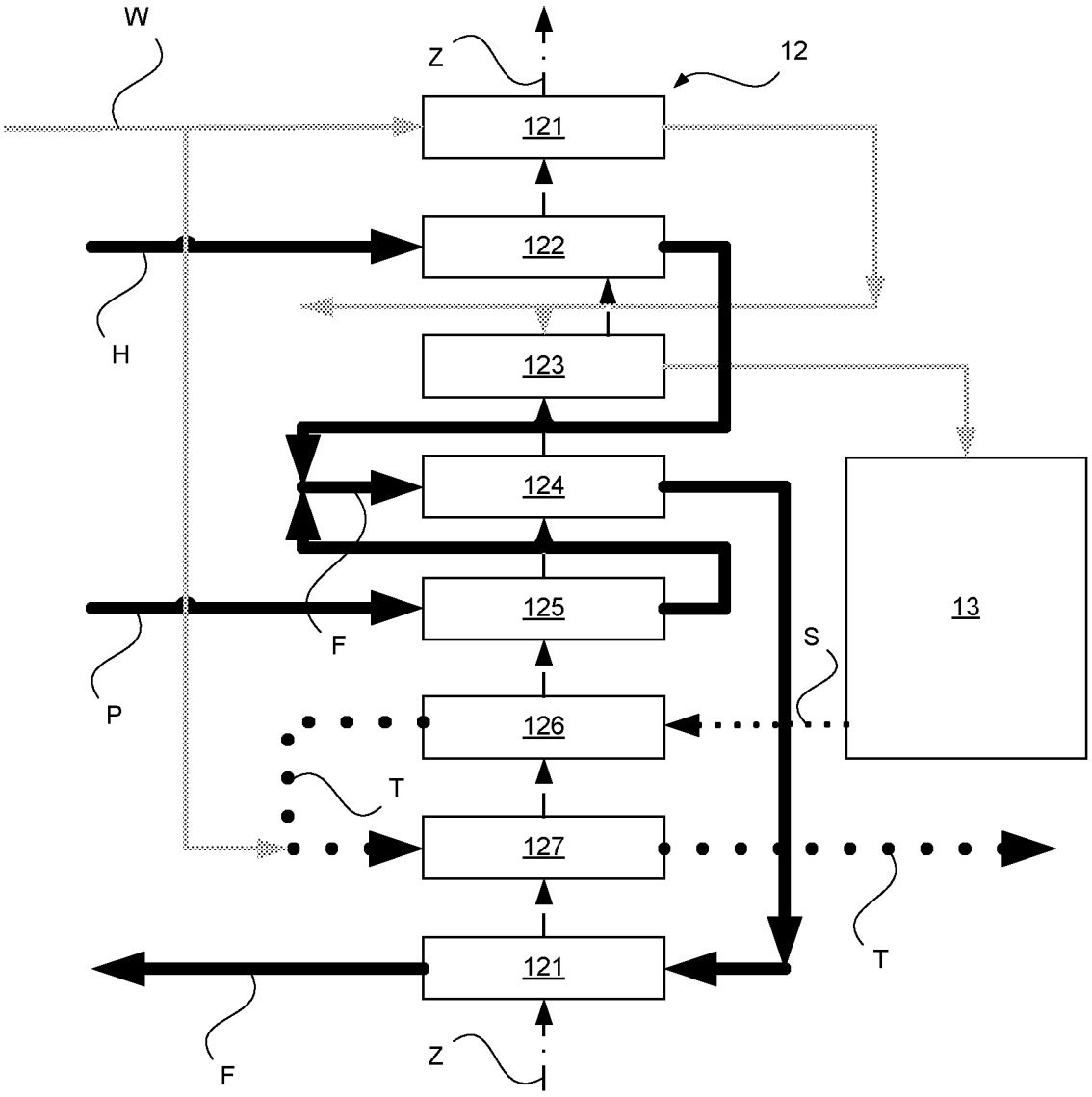

The topology of the underlying convection zone 12 is shown in particular in FIG. 4. However, other process arrangements can also be used within the scope of the invention. This topology comprises, counter to the direction of the outflowing flue gas Z, first feed water preheating 121, input preheating 122, second feed water preheating 123, a first high-temperature bundle 124, process steam superheating 125, first (super-)high-pressure steam superheating 126, second (super-)high-pressure steam superheating 127, and a second high-temperature bundle 128.

Feed water W is conducted through the first feed water preheating 121 and the second feed water preheating 123 and then fed to a corresponding (super-)high-pressure steam generator, for example in the cracking gas coolers 13. Not yet superheated (super-)high-pressure steam S, generated there, is guided through the first (super-)high-pressure steam superheating 126 and the second (super-)high-pressure steam superheating 127, obtaining superheated (super-)high-pressure steam T, wherein it is possible for a feed water injection to take place between the first (super-)high-pressure steam superheating 126 and the second (super-)high-pressure steam superheating 127. Hydrocarbon input H is heated in the input preheating 122, and process steam P is heated in the process steam superheating 125, before both are combined to form the feed stream F and further heated in the first high-temperature bundle 124 and the second high-temperature bundle 128.

The explanations relating to FIGS. 1 to 4 also apply to the following figures, and the reference signs used in FIGS. 1 to 4 are also used in the following figures. In the following figures, for the sake of clarity not all material flows are referred to repeatedly.

FIGS. 5 to 10 illustrate variants, denoted 1A to 1F, of systems for steam cracking according to a first group of embodiments according to the invention. The feature connecting these is the use of cooled feed water for maximum energy recovery. In this case, the principle of all shown variants 1A to 1F is, as mentioned, that of using the feed water already present at the furnace unit 10 as a heating medium for the air preheating 75 and optionally also for the heating gas preheating 65 in the low-temperature range, i.e., in a temperature range up to 100° C. The cooled feed water exiting from the preheating 75 and, if appropriate, 65 is fed thereafter to the convection zone 12, but, as also already mentioned, at noticeably reduced temperature compared to the prior art.

The preheating shown in FIGS. 5 to 10 can, as mentioned, consist of multiple stages, for example a first stage using feed water as the heating medium, a second stage using medium-pressure steam as the heating medium, and a third stage using (super-)high-pressure steam as the heating medium.

Further possible heating types or heating media can be used in addition, as mentioned. Furthermore, more or fewer preheating stages can also be provided, as also mentioned. For use of outflowing heating medium or recirculation of condensate into the steam generation, reference is likewise made to the above explanations.

Figure 5:
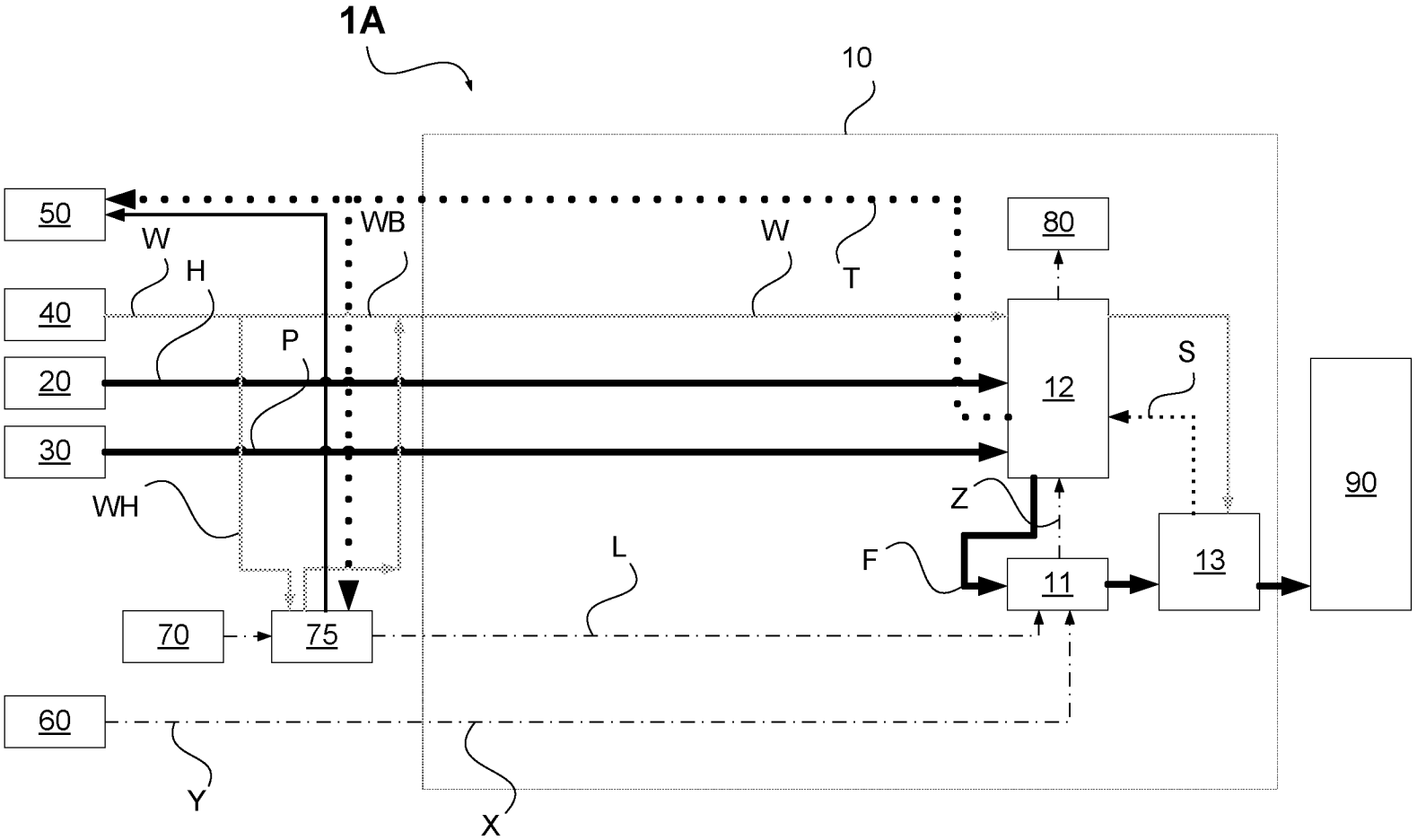
FIGS. 5 to 22 show arrangements according to embodiments of the invention and, where mentioned in each case, arrangements not according to the invention.

In the variant 1A illustrated in FIG. 5, a portion of the feed water W is used as a corresponding heating current WH in the central air preheating 75. A further portion can be guided as a bypass WB past the central air preheating 75, in order to realize the explained control possibility. The latter is also the case in variants 1B to 1F explained below.

Figure 6:
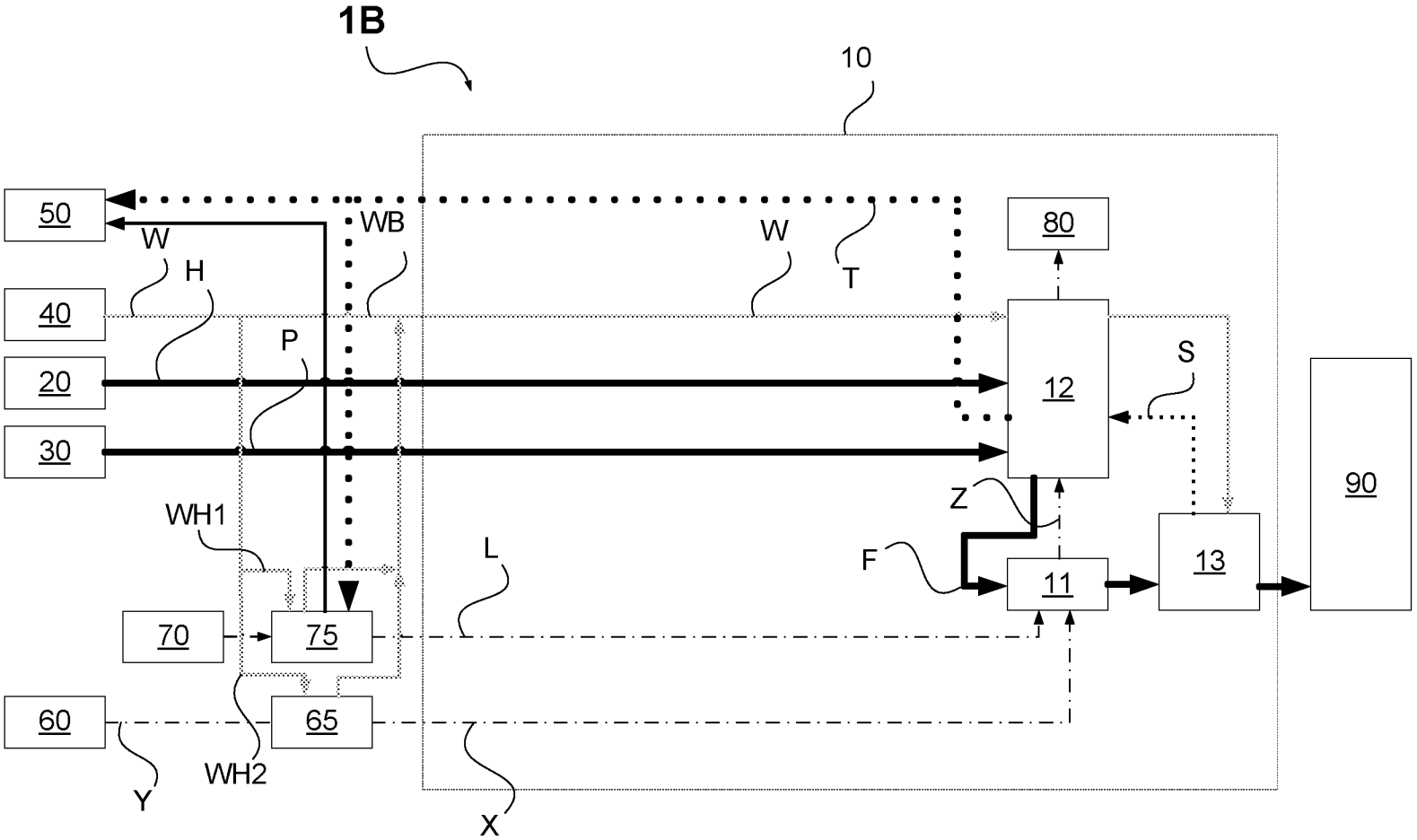

In the variant 1B illustrated in FIG. 6, portions of the feed water W are used as heating streams WH1, WH2 in the central air preheating 75 and the central heating gas preheating 65.

Figure 7:
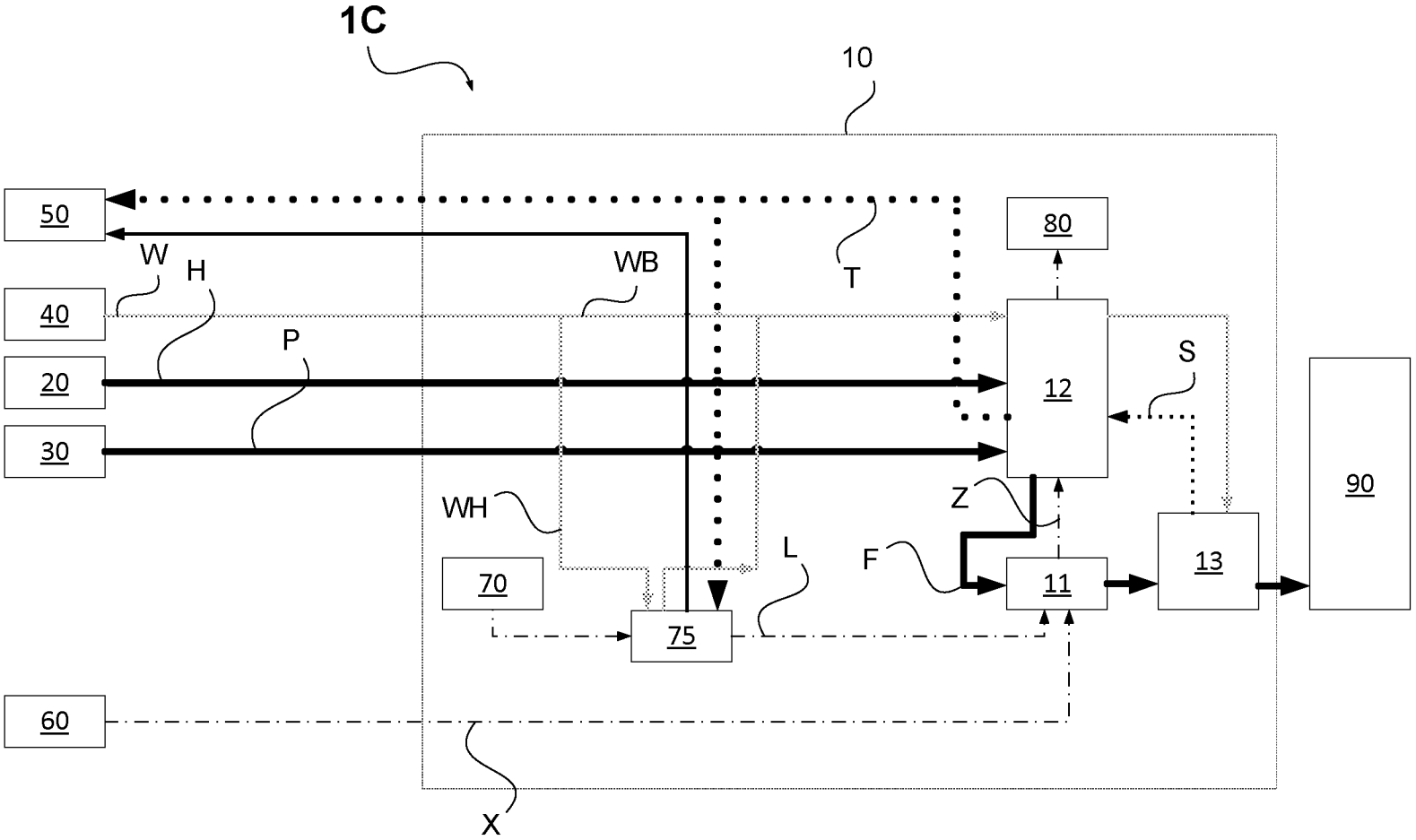

In the variant 1C illustrated in FIG. 7, peripheral air preheating 75 is heated using feed water WH, whereas no heating gas preheating takes place.

Figure 8:
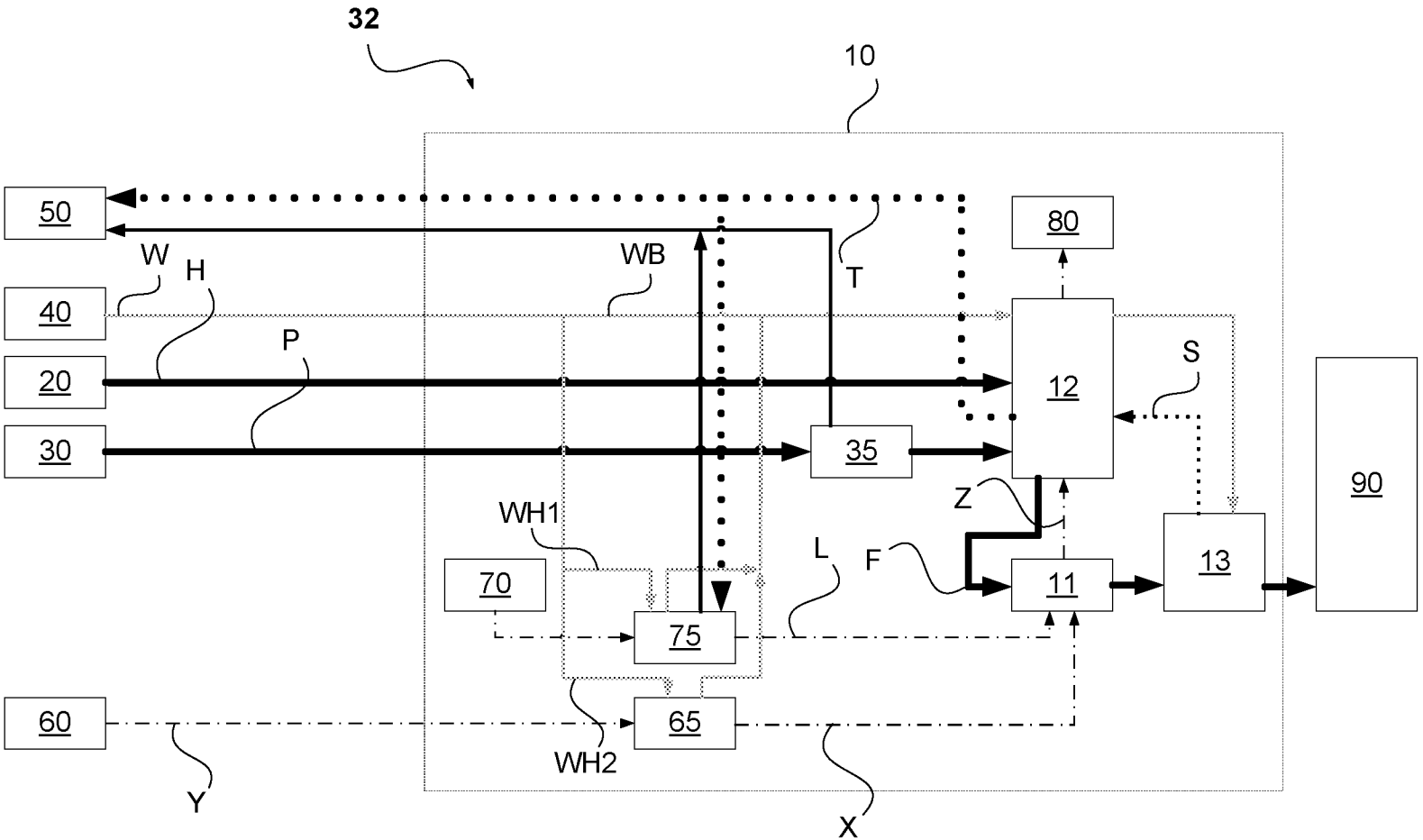

In the variant 1D illustrated in FIG. 8, both peripheral air preheating 75 is heated using feed water WH1 and peripheral heating gas preheating 65 is heated using feed water WH 2.

Figure 9:
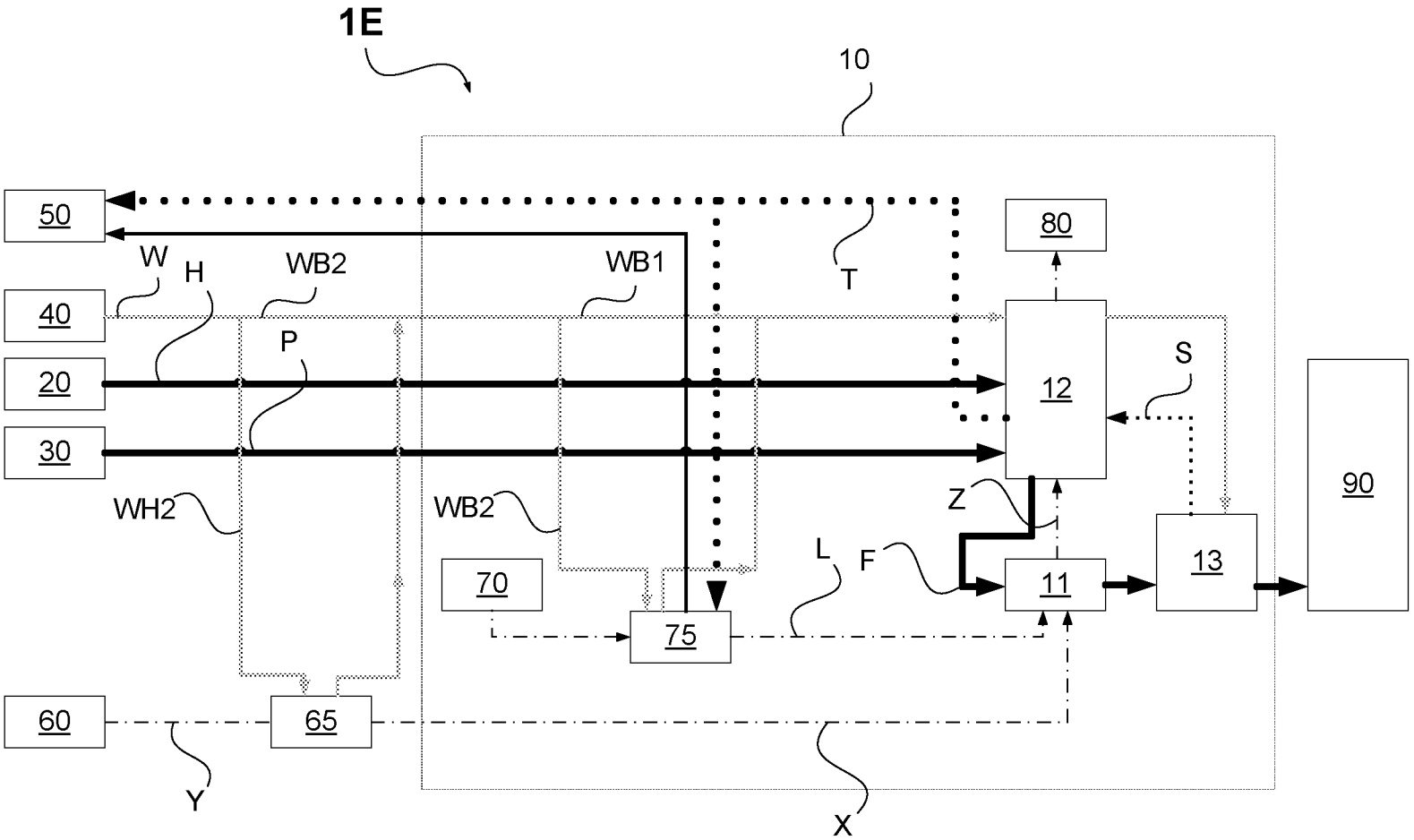

In the variant 1E illustrated in FIG. 9, peripheral air preheating 75 is heated feed water WH1 takes place, but also central heating gas preheating 65 is heated using feed water WH2. This results in two bypasses, designated WB1, WB2.

Figure 10:
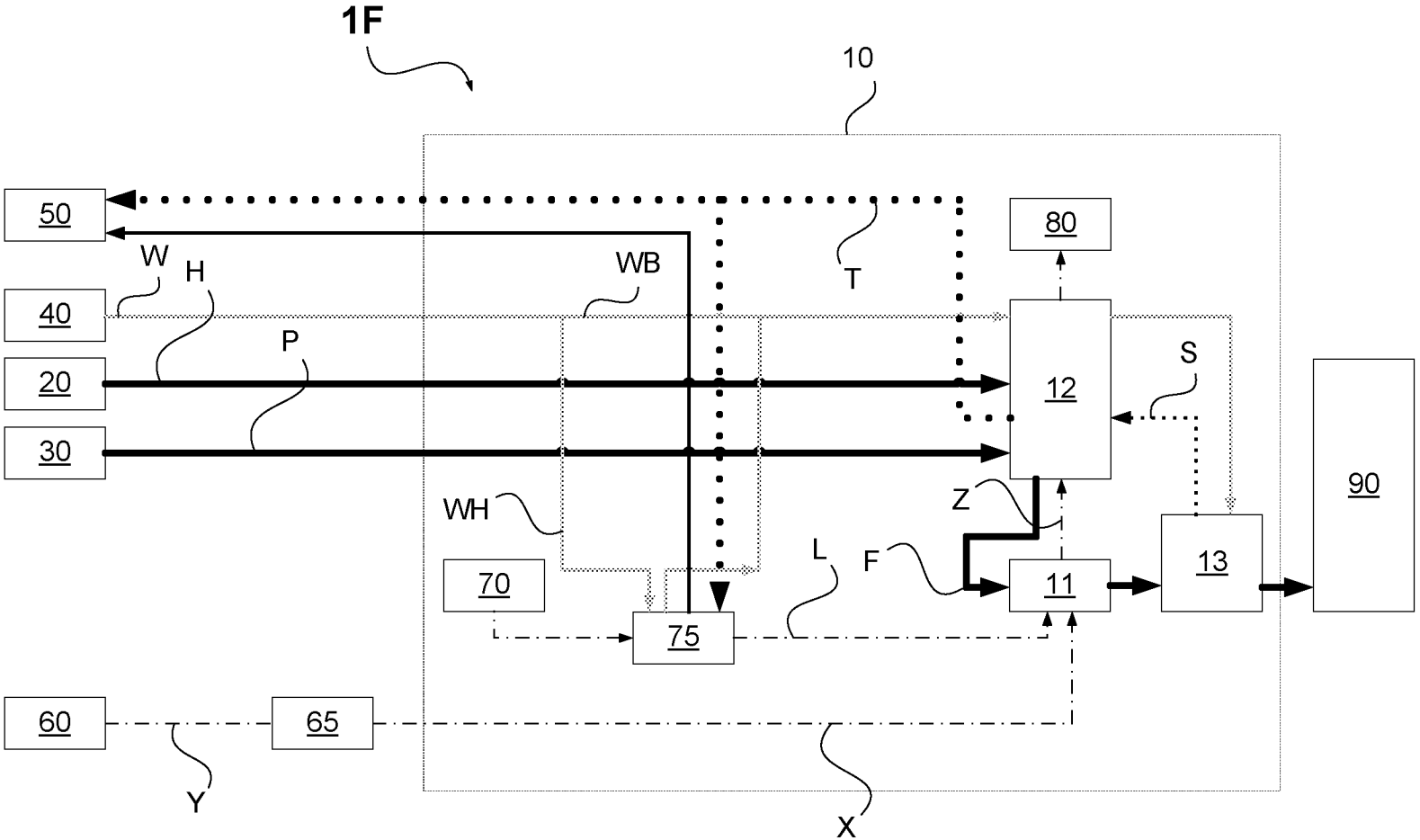

In the variant 1F illustrated in FIG. 10, peripheral air preheating 75 is heated using feed water WH, whereas central heating gas preheating 65 is carried out without heating using feed water.

Figure 11:
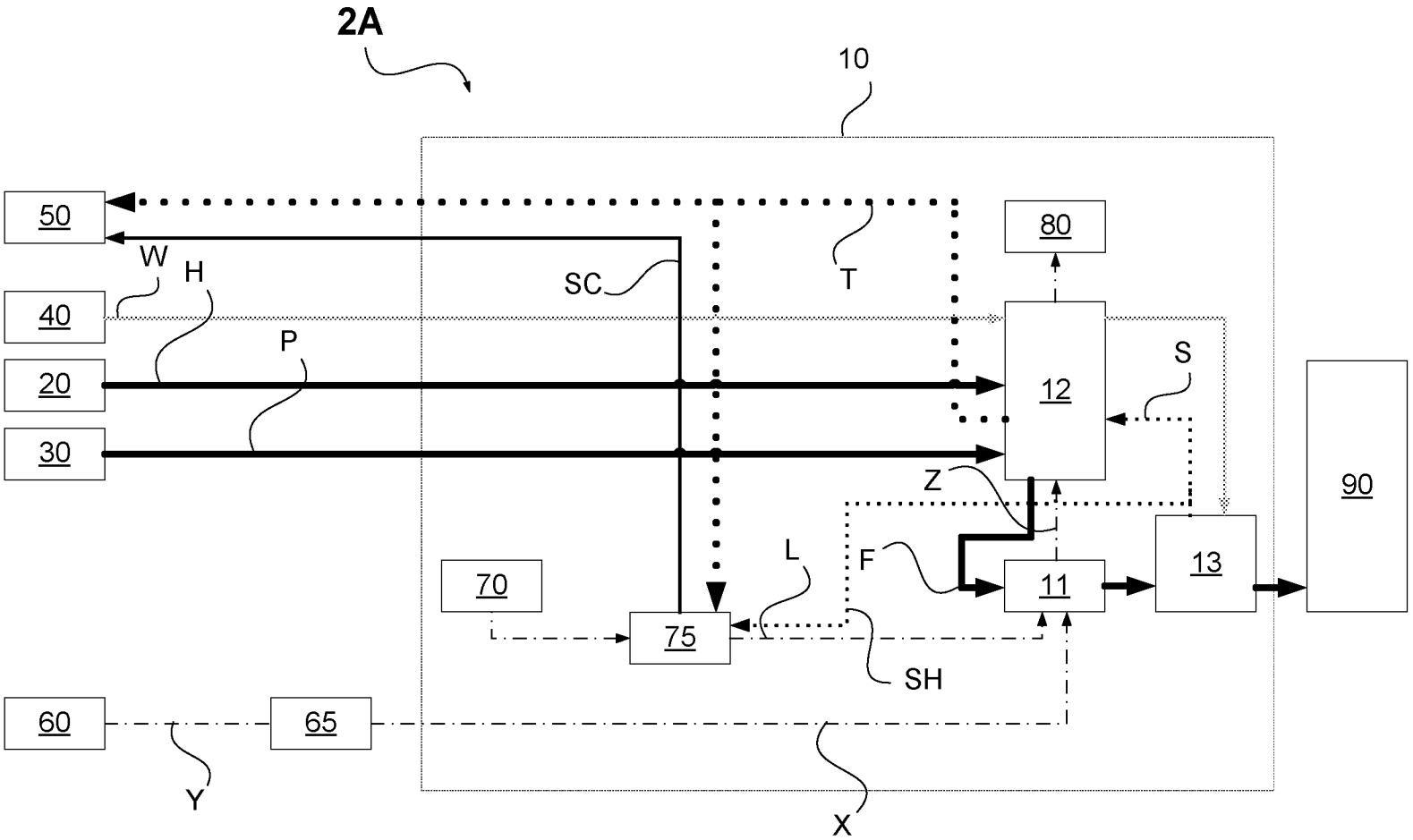
Figure 12:
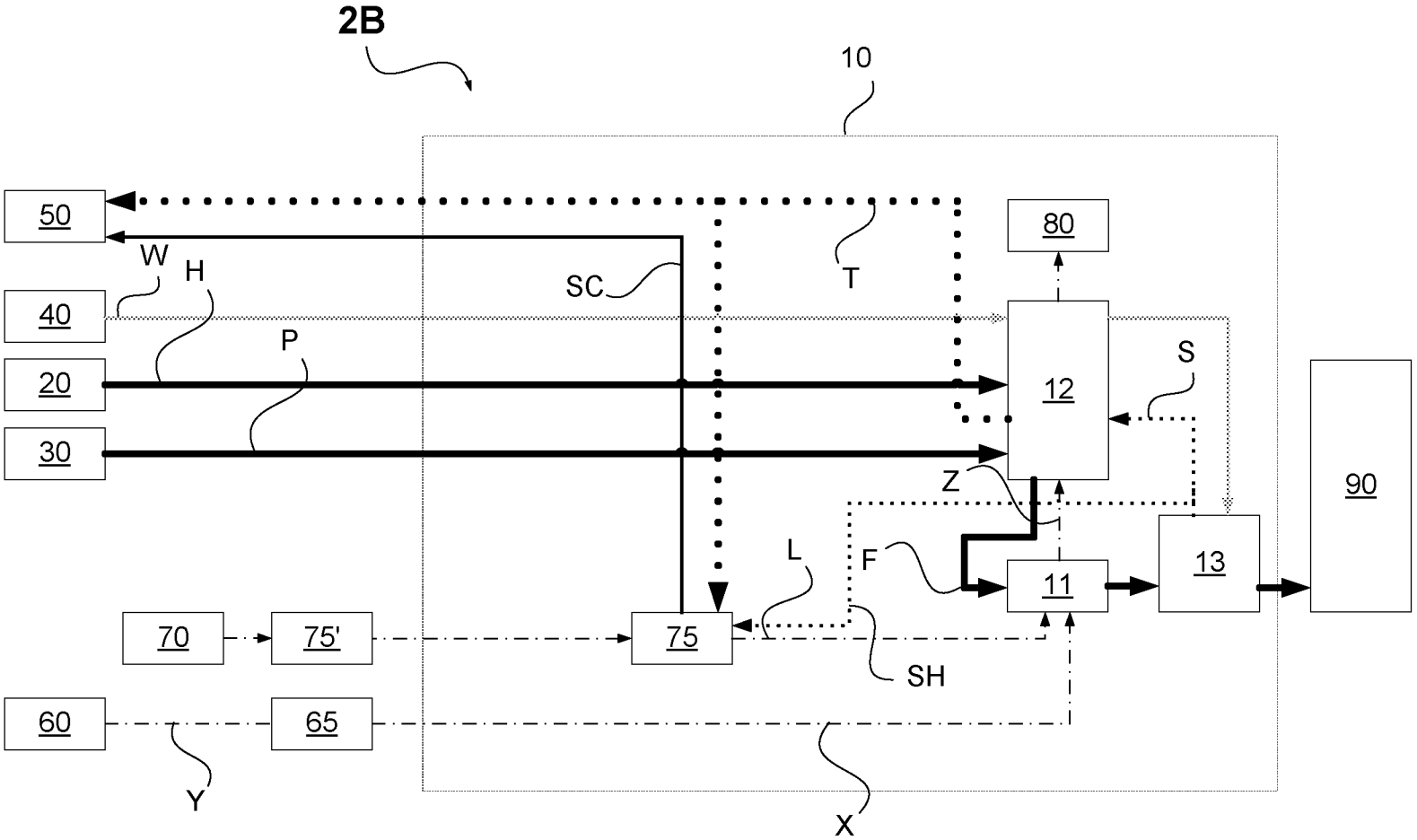
Figure 13:
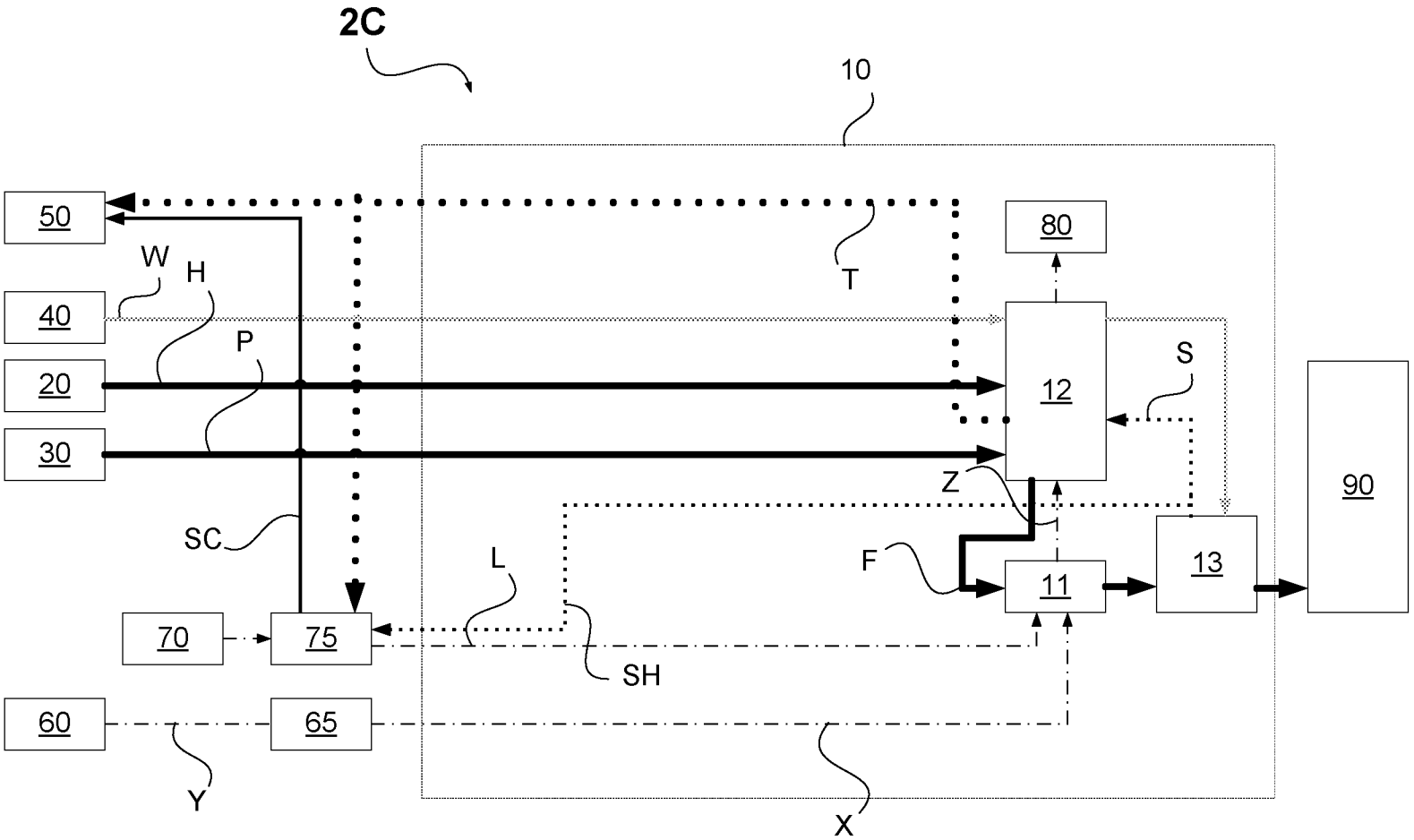

FIGS. 11 to 13 illustrate variants, denoted 2A to 2C, of systems for steam cracking according to a second group of embodiments not according to the invention. The feature connecting these is the use of (super-)high-pressure saturated steam specific to the furnace as the heating medium in the air preheating 75. The principle of the variants shown is that of using the saturated steam S generated in the steam generator 13 of the same cracker furnace 10, in part as a heating medium for the heating 75 of air in the medium to high temperature range, i.e., in a temperature range from 150 to 330° C. The amount of saturated steam supplied to the steam superheaters 126, 127 in the convection zone 12 (cf. FIG. 4) is reduced accordingly, as a result of which proportionally more exhaust gas heat is available to the heat exchangers 121 to 125 arranged downstream in the path of the flue gas Z in the convection zone 12.

In the variants 2A and 2B illustrated in FIGS. 11 and 12, these measures are used together with peripheral air preheating 75, central air preheating additionally present in the variant 2B illustrated in FIG. 12, which central preheating is denoted by 75' for better differentiation. However, the variant 2C illustrated in FIG. 13 comprises only central air preheating. In all cases, a corresponding saturated steam stream used for heating is denoted by SH. Condensate formed from this is designated SC. In the illustrated examples, this is returned to the central steam system 50.

As shown in FIGS. 11, 12 and 13 with respect to the variants 2A, 2B and 2C, the resulting (super-)high-pressure condensate can be fed to the central steam system of the plant, in order to continue to use the residual energy contained therein and finally to feed it to a suitable condensate preparation. It is also possible here to re-use the condensate formed, completely or in part, in previous preheating stages (i.e., at a lower temperature level), preferably after partial expansion to a reduced pressure level and addition of superheated steam at this reduced pressure level. However, it is also possible to provide subcooling of the condensate in the preheating, without prior expansion and admixing of superheated steam.

Figure 14:
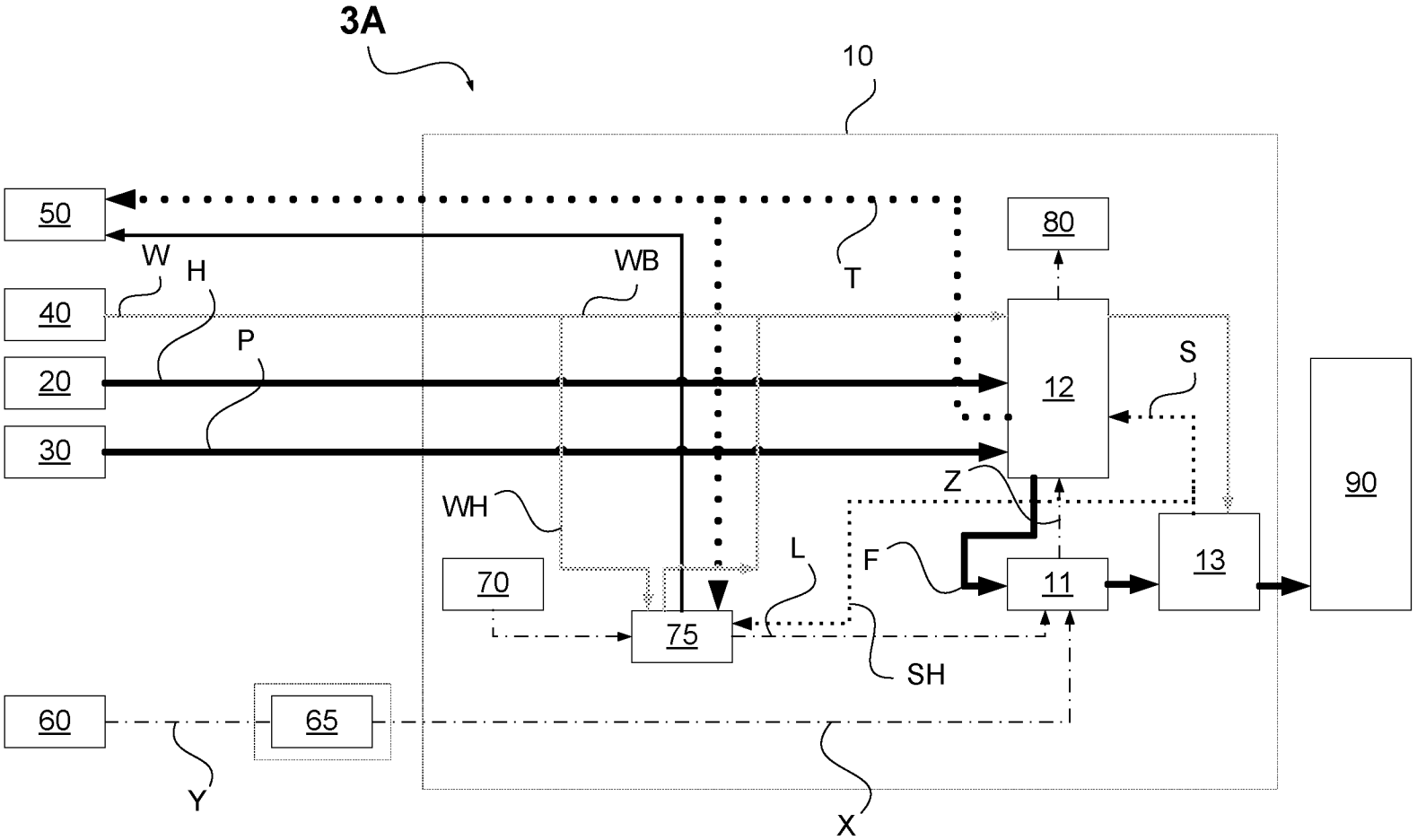
Figure 15:
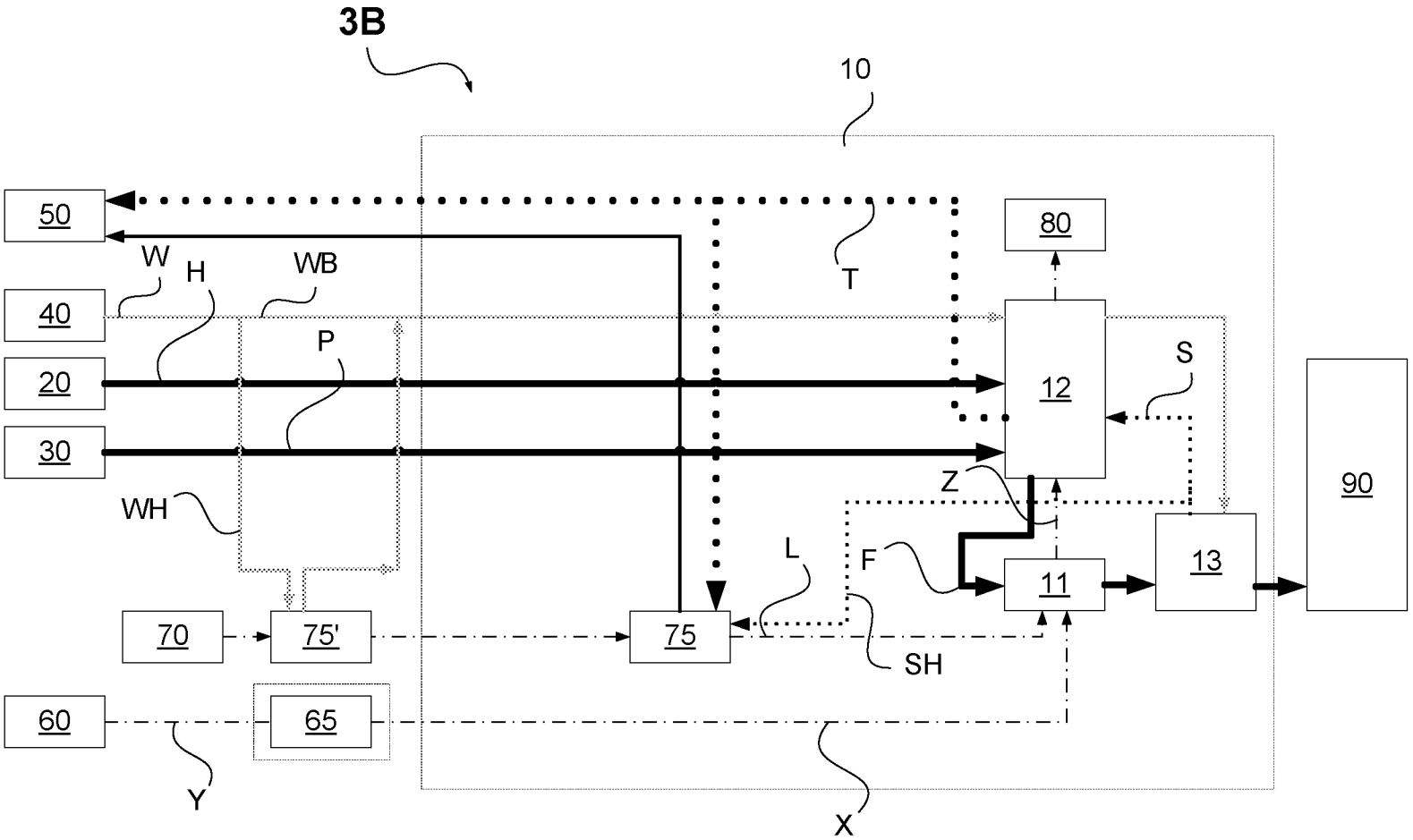

FIGS. 14 and 15 illustrate variants, denoted 3A and 3B, of systems for steam cracking according to a third group of embodiments according to the invention. The feature connecting these is a combined use of feed water and (super-) high-pressure saturated steam S as heating media in the air and/or heating gas preheating 65, 75. The principle of all the variants shown is to apply the measures, previously explained with respect to the first and second group of embodiments, together, i.e., to use feed water W for the air and/or heating gas preheating 65, 75 in the low-temperature range up to 100° C., and additionally to use saturated steam for the air preheating 75 in the medium or high-temperature range of 150 to 330° C.

As mentioned, the preheating can consist of multiple stages, for example a first stage using feed water as the heating medium, a second stage using medium-pressure steam as the heating medium, and a third stage using super-high-pressure saturated steam as the heating medium. Further possible heating types or heating media can be used in addition, as mentioned. Furthermore, more or fewer preheating stages can also be provided, as also mentioned. For use of outflowing heating medium or recirculation of condensate into the steam generation, reference is also made to the above explanations.

In the variant 3A illustrated in FIG. 14, these heating media are used together for peripheral air preheating 75, whereas in the variant 3B illustrated in FIG. 15 central air preheating is additionally provided, denoted 75' for better differentiability, the peripheral air preheating 75 using (super-)high-pressure saturated steam S, and the central air preheating 76 using feed water W.

Figure 16:
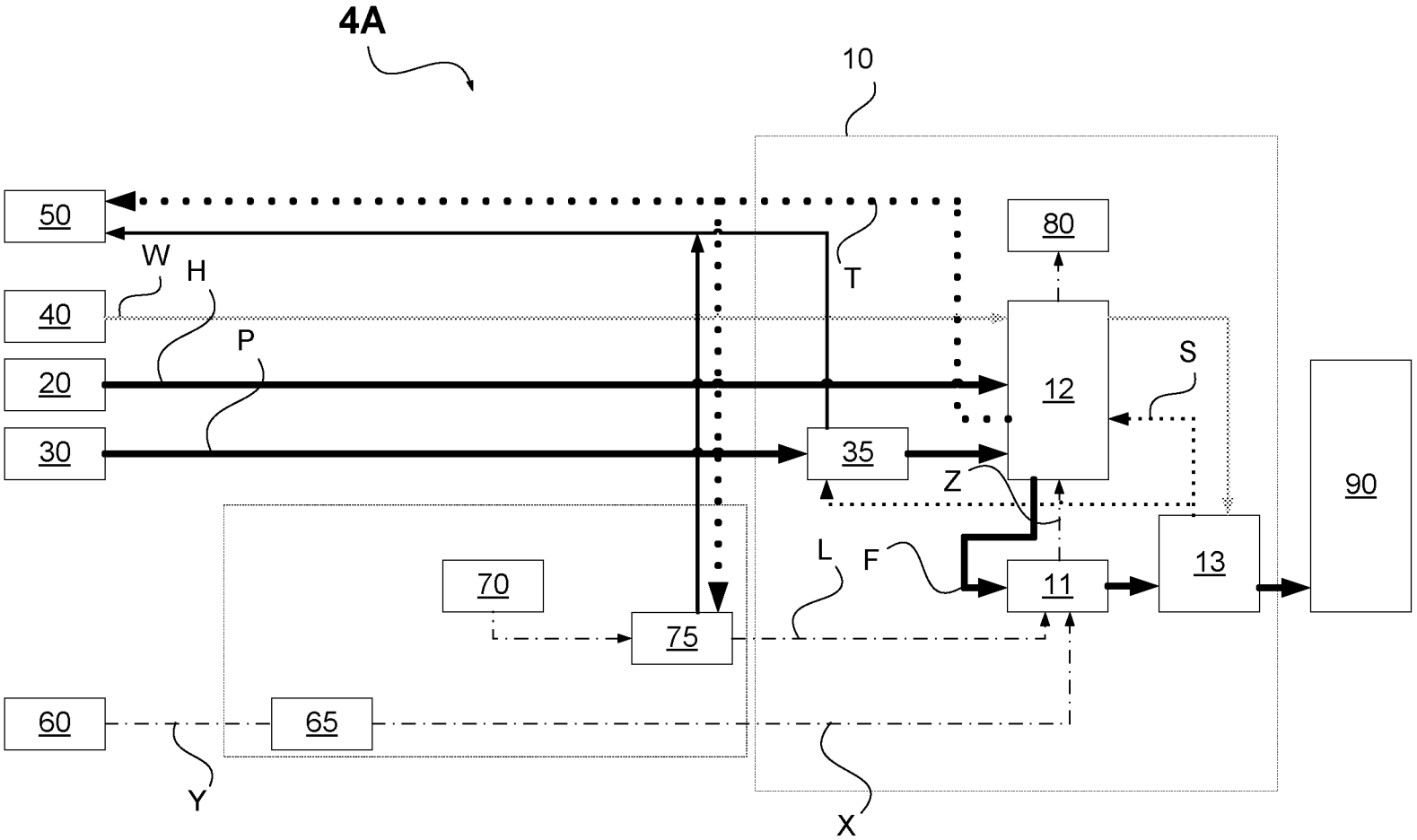
Figure 17:
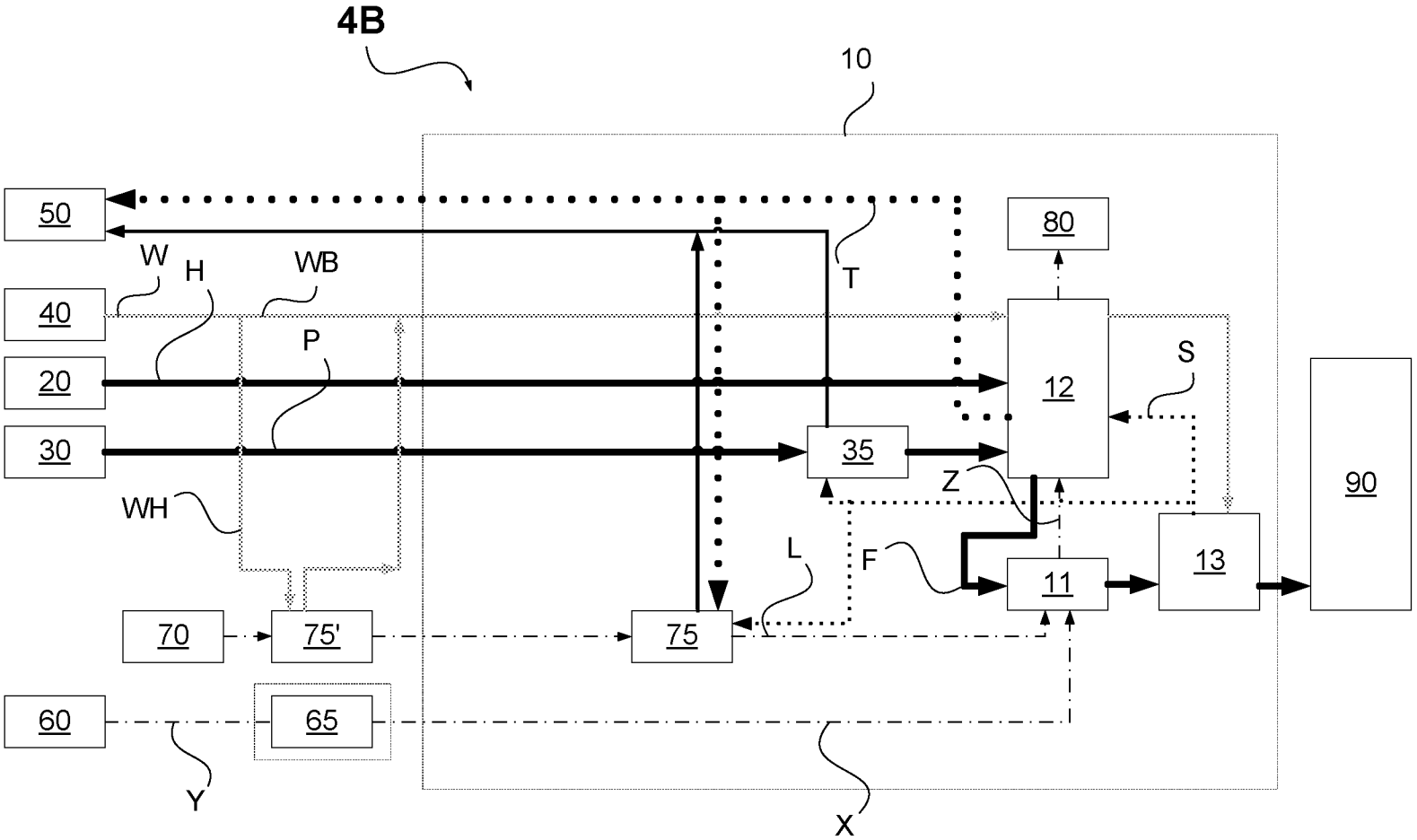

FIGS. 16 and 17 illustrate variants, denoted 4A and 4B, of systems for steam cracking according to a fourth group of embodiments, FIG. 16 showing an embodiment not according to the invention, and FIG. 17 showing an embodiment according to the invention. The feature connecting these is a use of (super-)high-pressure saturated steam S as the heating medium for the superheating of process steam P. The principle of all the variants shown is that of using in part the saturated steam S generated in the steam generator 13 of the same furnace 10 as a heating medium for the superheating of process steam P in the medium to high temperature range, i.e., in the temperature range from 150 to 330° C. The saturated steam quantity supplied to the steam superheaters 126, 127 for the saturated steam S in the convection zone 12 (cf. FIG. 4) is correspondingly reduced, as a result of which proportionally more exhaust gas heat at a higher temperature level is available to the heat exchangers 121 to 125 arranged downstream in the path of the flue gas Z in the convection zone 12. In addition, however, this also reduces the load of the process steam superheater 125 in the convection zone 12, in part or completely, so that yet more exhaust gas heat at a higher temperature level is available to the heat exchangers 121 to 124 arranged downstream of the process steam superheater 125 in the path of the flue gas Z in the convection zone 12.

In the variants 4A and 4B illustrated in FIGS. 16 and 17, peripheral process steam heating 35 is provided in each case, in the variant 4A illustrated in FIG. 16 only this being heated, but in contrast, in the variant illustrated in FIG. 17, peripheral air preheating 75' also being heated, using (super-)high-pressure saturated steam S as the heating medium. The variant illustrated in FIG. 17 additionally has, as an embodiment according to the invention, a use of feed water for air preheating, in this case in upstream central air preheating 75.

Figure 18:
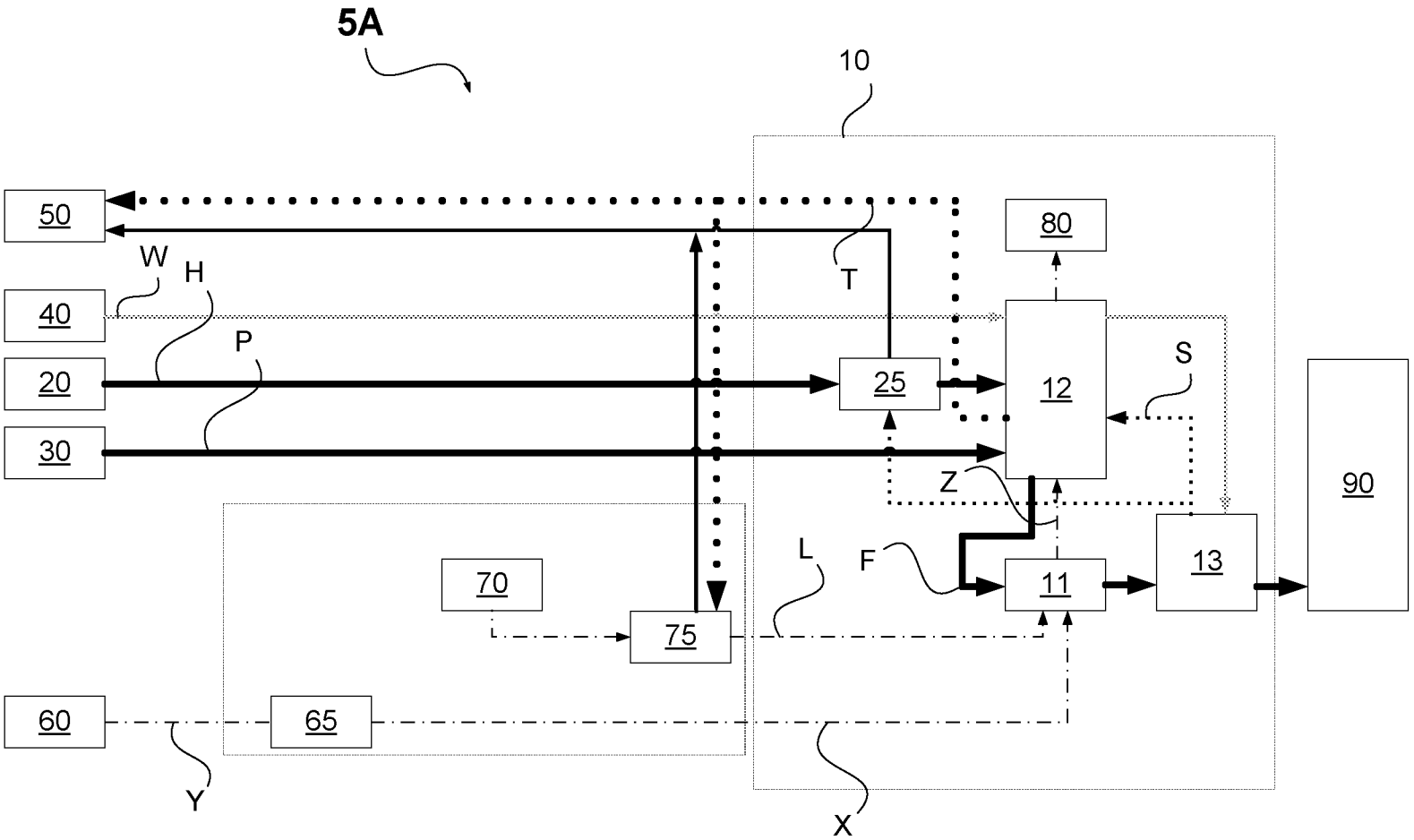
Figure 19:
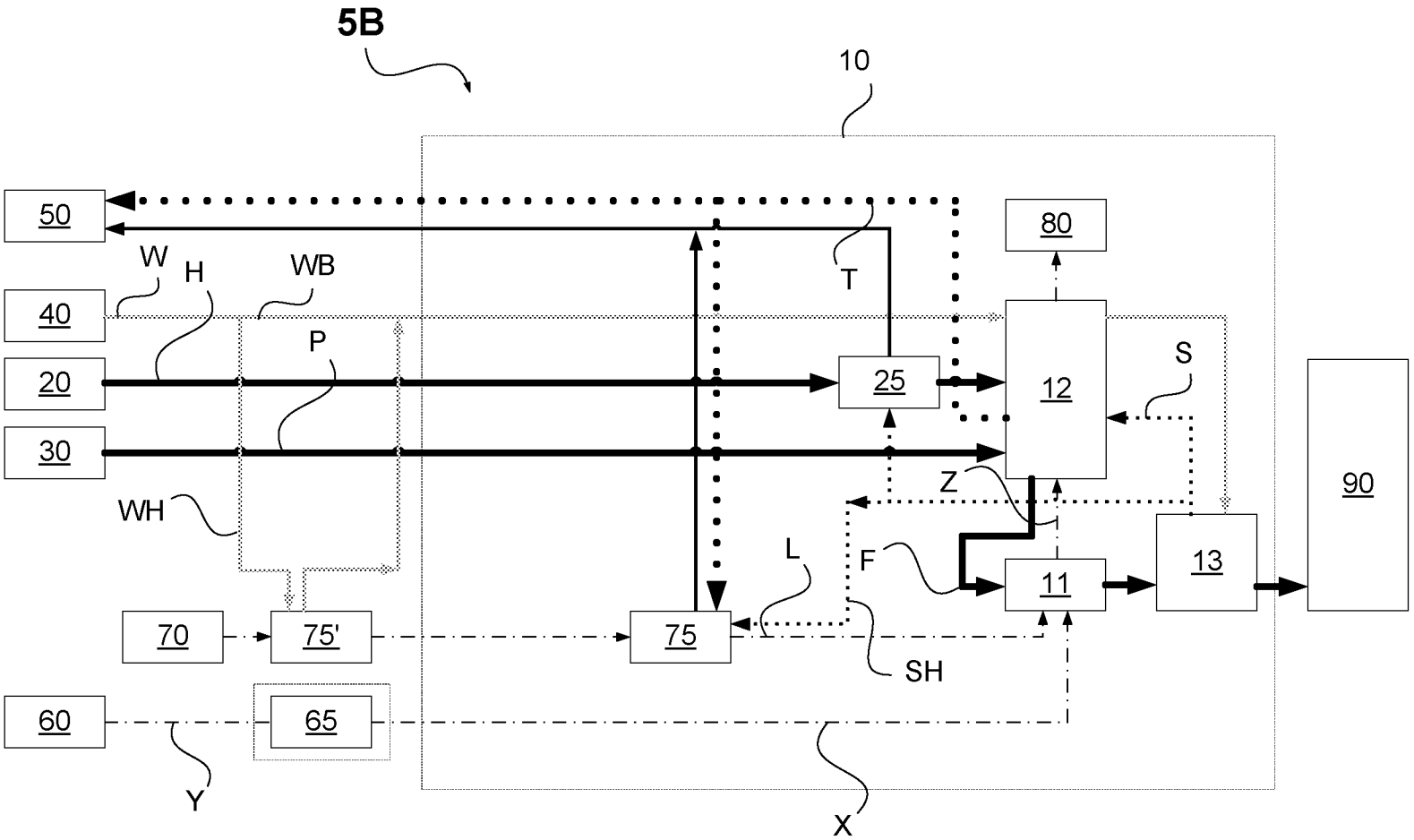

FIGS. 18 and 19 illustrate variants, previously denoted 5A and 5B, of systems for steam cracking according to a fifth group of embodiments, FIG. 18 showing an embodiment not according to the invention, and FIG. 19 showing an embodiment according to the invention. The feature connecting these is a use of (super-)high-pressure saturated steam S as the heating medium for the preheating of the hydrocarbon feed H. The principle of all the variants shown is to use the saturated steam S produced in the steam generator 13 of the same cracking furnace 10 in part as a heating medium for the preheating of the hydrocarbon feed H (incl. possible partial evaporation in the case of liquid inputs) in the medium to high-temperature range of from 100 to 330° C. In this case, a single-phase preheating of the input stream takes place on the input side (liquid or gaseous). In addition, partial or complete phase transition from liquid to gaseous can also take place (depending on the input and exit temperature). The saturated steam quantity supplied to the steam superheaters 126, 127 for the saturated steam S in the convection zone 12 (cf. FIG. 4) is correspondingly reduced, as a result of which proportionally more exhaust gas heat at a higher temperature level is available to the heat exchangers 121 to 125 arranged downstream in the path of the flue gas Z in the convection zone 12. In addition, the load of the input preheater 121 in the convection zone 12 is partially or completely reduced, so that even more exhaust gas heat is available at a higher temperature level for the downstream heat exchanger 121.

In this case, however, in the variants 5A and 5B illustrated in FIGS. 18 and 19 a peripheral input heating 25 is provided in each case, in the variant 5A illustrated in FIG. 18 only this being heated, and in contrast, in the variant illustrated in FIG. 19, peripheral air preheating 75' also being heated, using (super-)high-pressure saturated steam S the as heating medium. The variant illustrated in FIG. 19 additionally has, as an embodiment according to the invention, a use of feed water for air preheating, in this case in an upstream central air preheating 75.

Figure 20:
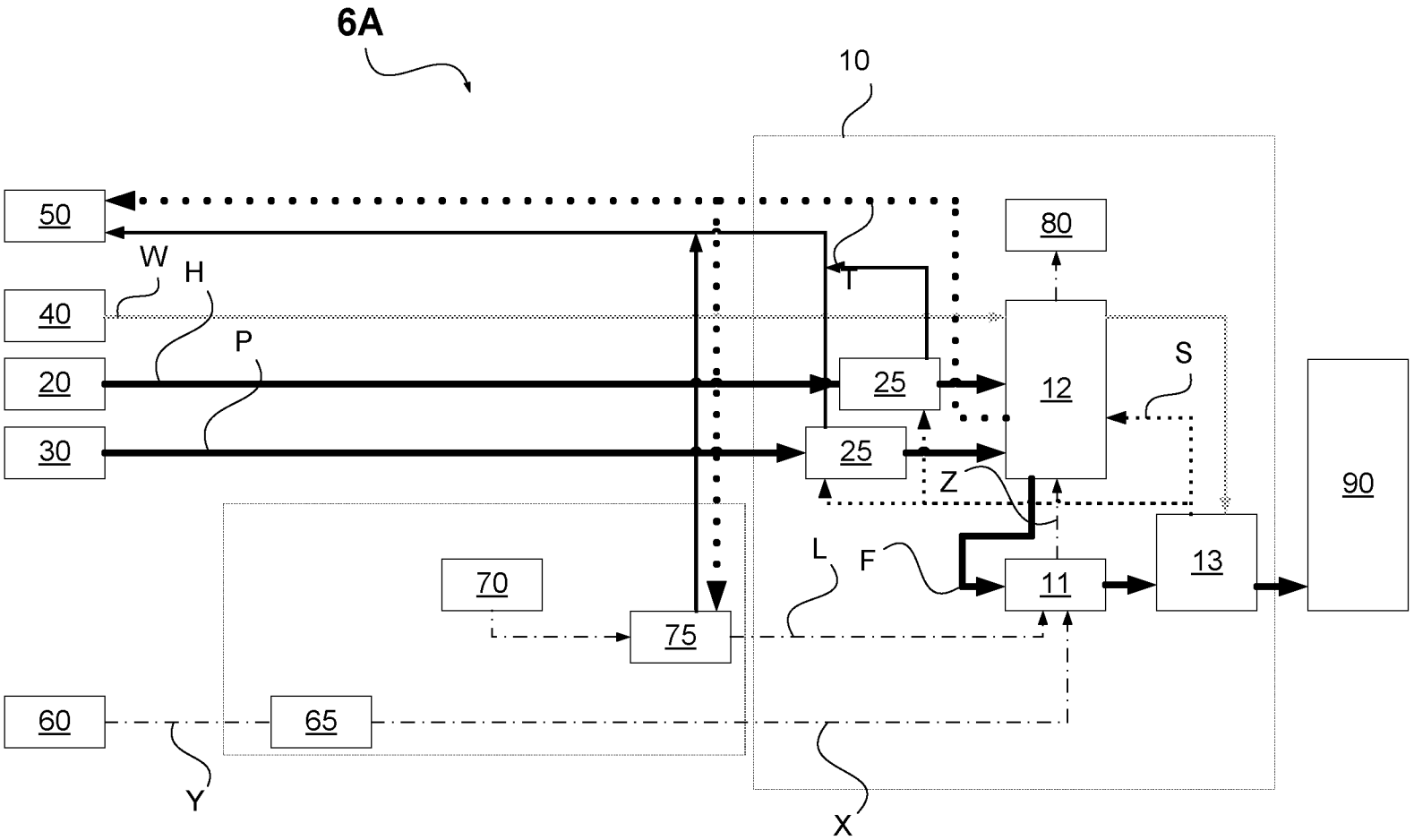
Figure 21:
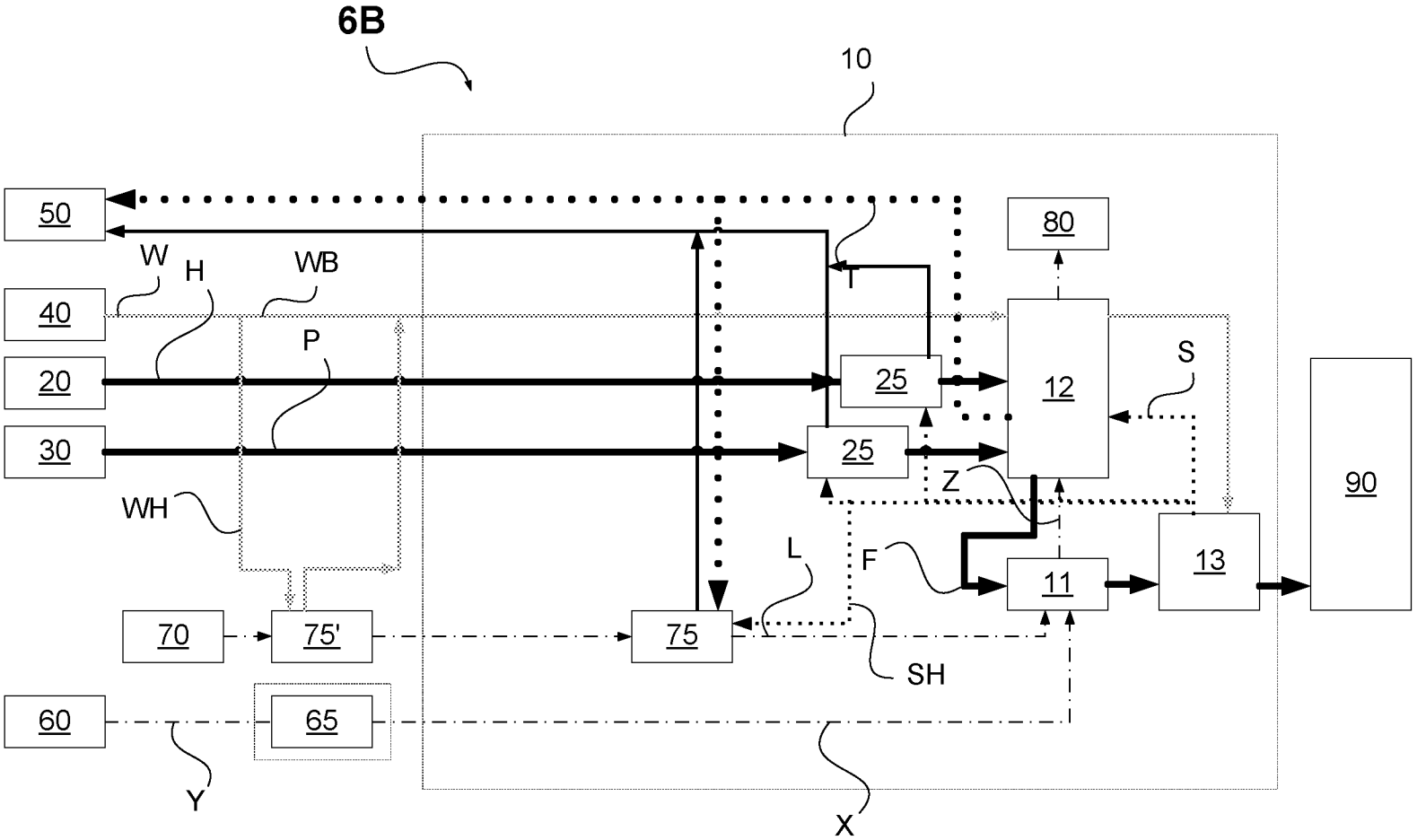
Figure 22:
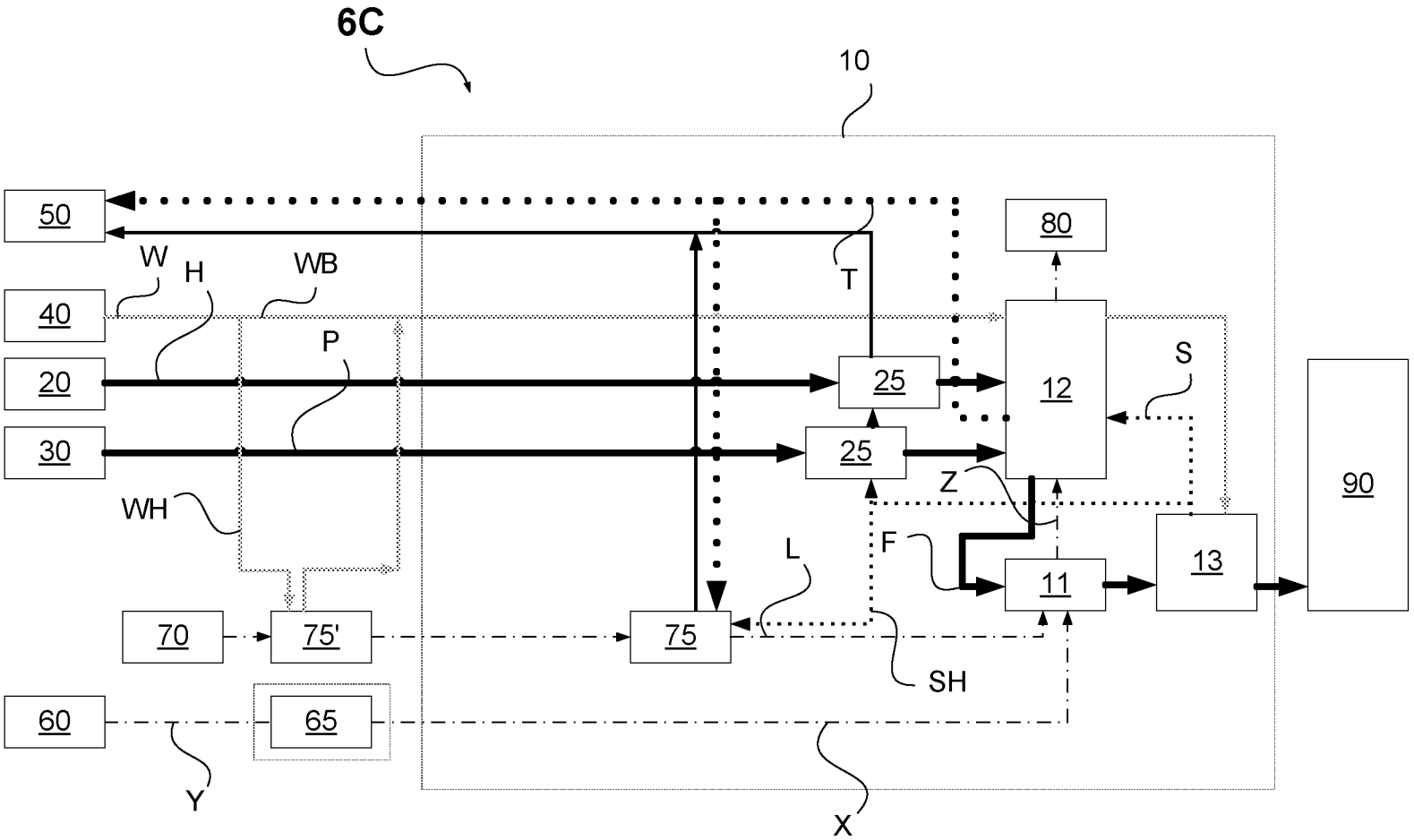

FIGS. 20 to 22 illustrate variants, previously denoted 6A to 6C, of systems for steam cracking according to a sixth group of embodiments, with FIG. 20 showing an embodiment not according to the invention, and FIGS. 21 and 22 showing embodiments according to the invention. The feature connecting these is a combined use of (super-)high-pressure saturated steam S as the heating medium for process steam superheating and input preheating. The principle of all the variants shown is to use the saturated steam S generated in the steam generator 13 of the same cracking furnace 10 in part as a heating medium both for the superheating of process steam P in the medium to high-temperature range of from 150 to 330° C. and for the preheating of the hydrocarbon input stream H (incl. possible partial evaporation in the case of liquid inputs) in the medium to high-temperature range of from 100 to 330° C. The amount of saturated steam supplied to the steam superheaters 126, 127 for the (super-)high-pressure saturated steam S in the convection zone 12 (cf. FIG. 4) is correspondingly reduced, as a result of which proportionally more exhaust gas heat at a higher temperature level is available to the heat exchangers 121 to 125 arranged downstream in the path of the flue gas Z in the convection zone 12. In addition, the load of the superheater 125 for process steam P in the convection zone 12 is reduced in part or completely, so that yet more exhaust gas heat at a higher temperature level is available for the downstream heat exchangers 121 to 124.

In this case, in the variants 6A to 6C illustrated in FIGS. 20 to 22, peripheral input heating 25 and peripheral process steam superheating 35 are provided in each case. In the variants 6A and 6B illustrated in FIGS. 20 and 21, these units are charged with saturated steam S in the manner shown. In the variant 6C illustrated in FIG. 22, the process steam superheating 35 and the input preheating 25 are connected in series on the heat carrier medium side. In the variants 6B and 6C illustrated in FIGS. 21 and 22, peripheral air preheating 75' is additionally charged with saturated steam S. The variants illustrated in FIGS. 21 and 22 also have, as embodiments according to the invention, a use of feed water for air preheating, in this case in upstream central air preheating 75.

Figure 23:
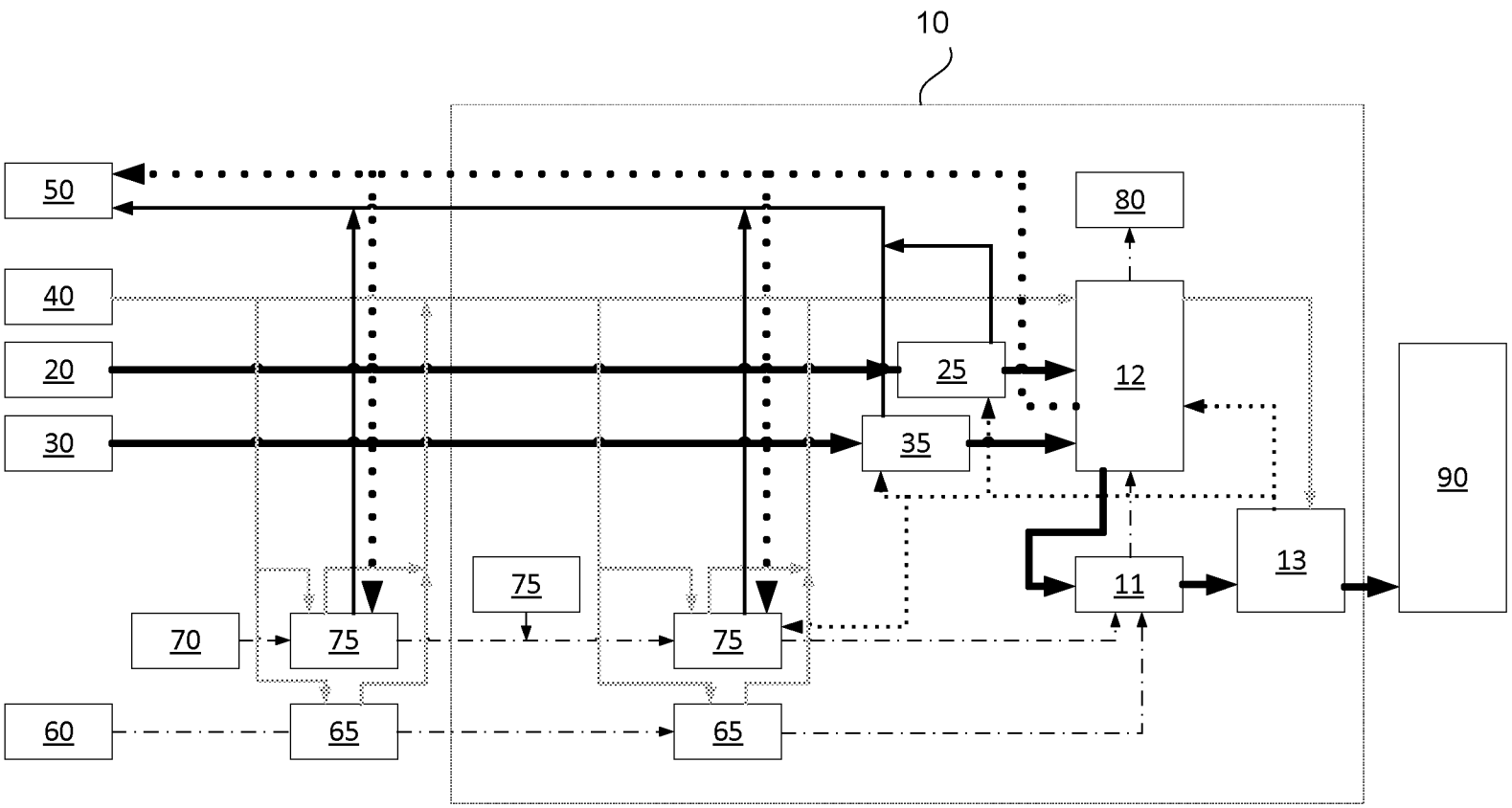
FIG. 23 summarizes embodiments of the invention and embodiments not according to the invention, in a schematic diagram.

FIG. 23 summarizes embodiments of the invention and embodiments not according to the invention in a schematic diagram, the corresponding material flows not being designated again separately. FIG. 23 illustrates in particular the possibility for central and peripheral provision of the units explained above.

The invention claimed is:

1. A method for reacting one or more hydrocarbons by steam cracking, comprising:

preheating combustion air at least in part by heat exchange with feed water, wherein the feed water is provided at a temperature level of 80 to 140° C. and a pressure level of 30 to 175 bar absolute pressure and is cooled to a temperature level of 40 to 100° C. during the heat exchange;

preheating the feed water downstream of the heat exchange in at least one convection zone of at least one cracker furnace to produce preheated feed water;

producing steam from the preheated feed water;

firing heating gas with the preheated combustion air to heat at least one radiant zone of the at least one cracker furnace; and steam cracking at least one input stream containing one or more hydrocarbons and the steam in the at least one radiant zone to obtain at least one product stream.

2. The method according to claim 1, wherein the steam produced from the feed water comprises superheated and/or non-superheated high-pressure and/or super-high-pressure steam formed from the feed water after the feed water preheating.

3. The method according to claim 2, wherein the steam is produced by subjecting at least a portion of the feed water to feed water evaporation after the feed water preheating, the feed water evaporation being performed using heat withdrawn from at least a portion of the at least one product stream, to obtain the high-pressure and/or super-high-pressure steam.

4. The method according to claim 2, wherein the combustion air preheating is further performed using heat withdrawn from a portion of the superheated high-pressure or super-high-pressure steam.

5. The method according to claim 3, wherein at least a portion of the high-pressure or super-high-pressure steam is subjected to steam superheating in the at least one convection zone to obtain superheated high-pressure or super-high-pressure steam.

6. The method according to claim 3, wherein the combustion air preheating is further performed using heat withdrawn from a portion of the superheated high-pressure or super-high-pressure steam.

7. The method according to claim 3, wherein the feed water is subjected to the feed water preheating at a pressure level of 30 to 60 bar absolute pressure or 60 to 175 bar absolute pressure.

8. The method according to claim 5, wherein the combustion air preheating is further performed using heat withdrawn from a portion of the superheated high-pressure or super-high-pressure steam.

9. The method according to claim 1, further comprising subjecting the heating gas to heating gas preheating which is carried out using heat which is withdrawn from at least a portion of the feed water upstream of the feed water preheating.

10. The method according to claim 1, wherein the feed water preheating is performed in one or more flue gas channels in the at least one convection zone, and wherein the feed water preheating is performed at a lower temperature level than a temperature level used for steam superheating to obtain superheated high-pressure or super-high-pressure steam and at a lower temperature level than a temperature level used for process steam superheating to provide sufficiently heated process steam which is used to form the at least one input stream.

11. The method according to claim 1, wherein the feed water is subjected to the feed water preheating at a pressure level of 30 to 60 bar absolute pressure or 60 to 175 bar absolute pressure.

12. The method according to claim 1, wherein multiple cracker furnaces are used which are supplied with the feed water by means of a central feed water system, the combustion air preheating being carried out separately for each of the multiple cracker furnaces or together for the multiple cracker furnaces.

13. The method according to claim 1, wherein the combustion air pre heating is further carried out using saturated steam and/or steam condensate formed therefrom.

14. The method according to claim 1, wherein a preheating of the one or more input streams and/or one or more substance streams used for the formation thereof is carried out using saturated steam and/or steam condensate formed therefrom.

* * * * *